US007570900B2

(12) United States Patent
Chadani et al.

(10) Patent No.: US 7,570,900 B2
(45) Date of Patent: Aug. 4, 2009

(54) PROCESS CARTRIDGE RECEIVING FROM AN IMAGE FORMING APPARATUS INTO WHICH IT IS MOUNTED A DOWNSTREAM-MOVING FORCE DURING MOUNTING AND SUCH IMAGE FORMING APPARATUS

(75) Inventors: Kazuo Chadani, Shizuoka-ken (JP); Shigeru Hoashi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 458 days.

(21) Appl. No.: 11/402,058

(22) Filed: Apr. 12, 2006

(65) Prior Publication Data

US 2006/0228132 A1 Oct. 12, 2006

(30) Foreign Application Priority Data

Apr. 12, 2005 (JP) ..... 2005-114237

(51) Int. Cl.
*G03G 21/16* (2006.01)

(52) U.S. Cl. ..... 399/111

(58) Field of Classification Search ..... 399/111, 399/114

See application file for complete search history.

(56) References Cited

U.S. PATENT DOCUMENTS

| | | | | |
|---|---|---|---|---|
| 5,943,529 | A | 8/1999 | Miyabe et al. | 399/111 |
| 5,966,567 | A | 10/1999 | Matsuzaki et al. | 399/111 |
| 6,144,815 | A | 11/2000 | Chadani et al. | 399/27 |
| 6,173,140 | B1 | 1/2001 | Suzuki et al. | 399/113 |
| 6,173,145 | B1 | 1/2001 | Chadani et al. | 399/265 |
| 6,178,302 | B1 | 1/2001 | Nagashima et al. | 399/106 |
| 6,205,305 | B1 | 3/2001 | Suzuki et al. | 399/106 |
| 6,219,504 | B1 | 4/2001 | Matsuzaki et al. | 399/92 |
| 6,282,389 | B1 | 8/2001 | Matsuzaki et al. | 399/111 |
| 6,301,457 | B1 | 10/2001 | Chadani et al. | 399/167 |
| 6,453,135 | B1 * | 9/2002 | Sameshima et al. | 399/110 |
| 6,473,585 | B2 | 10/2002 | Abe et al. | 399/254 |
| 6,512,903 | B2 | 1/2003 | Chadani | 399/106 |
| 6,535,699 | B1 | 3/2003 | Abe et al. | 399/27 |
| 6,671,474 | B2 | 12/2003 | Chadani | 399/106 |
| 6,714,752 | B2 | 3/2004 | Ueno et al. | 399/117 |

(Continued)

FOREIGN PATENT DOCUMENTS

| | | |
|---|---|---|
| JP | 2000-98680 | 4/2000 |

(Continued)

*Primary Examiner*—David M Gray
*Assistant Examiner*—Andrew V Do
(74) *Attorney, Agent, or Firm*—Fitzpatrick, Cella, Harper & Scinto

(57) ABSTRACT

A process cartridge is detachably mountable to a main assembly of an electrophotographic image forming apparatus. The cartridge includes an electrophotographic photosensitive member, a cartridge positioning portion, engageable with the main assembly for positioning the cartridge relative to the main assembly, and a cartridge movable member movable by movement of a main assembly movable member, when the cartridge, upon mounting of the cartridge to the main assembly while guided by a main assembly guiding member, stops upstream, with respect to a cartridge mounting direction, of an image formation position where the cartridge positioning portion is engaged with the main assembly positioning portion, the cartridge movable member is moved by movement of a main assembly movable member to contact to the guiding member, by which the cartridge movable member receives, from the guiding member, a force for moving the process cartridge downstream with respect to the mounting direction.

9 Claims, 15 Drawing Sheets

U.S. PATENT DOCUMENTS

| | | | | |
|---|---|---|---|---|
| 6,795,666 | B2 | 9/2004 | Miyabe et al. | 399/109 |
| 6,823,155 | B2 | 11/2004 | Tsuda et al. | 399/111 |
| 6,829,455 | B2 | 12/2004 | Yasumoto et al. | 399/167 |
| 6,898,391 | B2 | 5/2005 | Numagami et al. | 399/90 |
| 6,931,226 | B2 | 8/2005 | Chadani et al. | 399/109 |
| 6,934,485 | B2 | 8/2005 | Miyabe et al. | 399/90 |
| 6,980,759 | B2 | 12/2005 | Kanno et al. | 399/111 |
| 7,092,658 | B2 | 8/2006 | Yasumoto et al. | 399/167 |
| 2002/0150404 | A1* | 10/2002 | Matsuzaka et al. | 399/111 |
| 2005/0176299 | A1 | 8/2005 | Chadani et al. | 439/607 |
| 2005/0254858 | A1 | 11/2005 | Numagami et al. | 399/167 |
| 2006/0008289 | A1 | 1/2006 | Sato et al. | 399/106 |
| 2006/0024080 | A1 | 2/2006 | Chadani et al. | 399/90 |

FOREIGN PATENT DOCUMENTS

| | | |
|---|---|---|
| JP | 2003-241618 | 8/2003 |

* cited by examiner

PROCESS CARTRIDGE RECEIVING FROM AN IMAGE FORMING APPARATUS INTO WHICH IT IS MOUNTED A DOWNSTREAM-MOVING FORCE DURING MOUNTING AND SUCH IMAGE FORMING APPARATUS

FIELD OF THE INVENTION AND RELATED ART

The present invention relates to an electrophotographic image forming apparatus, and a process cartridge removably mountable in an electrophotographic image forming apparatus.

In the field of an electrophotographic image forming apparatus which employs an electrophotographic image formation process, it has been a common practice to employ a process cartridge system, according to which an electrophotographic photosensitive drum, and a single or multiple processing means, which process an electrophotographic photosensitive member, are integrally disposed in a cartridge which is removably mountable in the main assembly of an image forming apparatus. Further, a process cartridge system makes it possible for a user to maintain an image forming apparatus, instead of relying on service personnel, drastically improving an electrophotographic image forming apparatus in operational efficiency. Thus, a process cartridge has been widely used in the field of an electrophotographic image forming apparatus.

The image forming operation of an electrophotographic image forming apparatus is as follows: A beam of light is projected by a laser, an LED, an ordinary lamp, or the like, onto an electrophotographic photosensitive drum, while being modulated by image formation information. As a result, an electrostatic latent image is effected on the photosensitive drum. This electrostatic latent image is developed by a developing apparatus into a developer image, that is, an image formed of developer. This developer image formed on the photosensitive drum is transferred onto a sheet of a recording medium, or the like, yielding thereby a sheet of a recording medium, or the like, which bears an image.

However, if a process cartridge fails to be mounted into its correct position in the main assembly of an electrophotographic image forming apparatus, it is possible that the image formation process carried out by the process cartridge will be affected. Therefore, various means have been devised to draw a process cartridge into the correct position in the main assembly of an electrophotographic image forming apparatus.

For example, Japanese Laid-open Patent Application 2000-98680 discloses a means for warning a user of an anomaly in cartridge position. According to this means, the state of a process cartridge in terms of the position of a process cartridge in the main assembly of an electrophotographic image forming apparatus, relative to the main assembly, is detected at a high level of accuracy, and if the cartridge position is abnormal, a user is informed of the anomaly. Also, Japanese Laid-open Patent Application 2003-241618 discloses a structural arrangement for a color image forming apparatus of the in-line type. According to this structural arrangement, when an electrostatic transfer belt unit is closed, it is pressed upon the process cartridges to press the cartridges deeper into the main assembly of the image forming apparatus.

SUMMARY OF THE INVENTION

The present invention is one of the results of the further development of the above described prior art.

The primary object of the present invention is to provide a process cartridge which is reliable in that it does not fail to be correctly mounted in the main assembly of an electrophotographic image forming apparatus, while being simple in structure, and an electrophotographic image forming apparatus which is reliable in that it ensures that a process cartridge is correctly mounted in the main assembly of the image forming apparatus, while being simple in structure.

Another object of the present invention is to provide a process cartridge which can be moved downstream, in terms of the direction in which the process cartridge is to be mounted into the main assembly of an electrophotographic image forming apparatus, when the process cartridge is guided by guiding members into the main assembly, after being inserted into the main assembly through the front opening of the main assembly, and an electrophotographic image forming apparatus which makes it possible for the process cartridge to be moved downstream, in terms of the direction in which the process cartridge is to be mounted into the main assembly of an electrophotographic image forming apparatus, when the process cartridge is guided by the guiding members into the main assembly, after being inserted into the main assembly through the front opening of the main assembly.

According to an aspect of the present invention, there is provided a process cartridge detachably mountable to a main assembly of an electrophotographic image forming apparatus. The apparatus includes an openable member movable between a closing position for closing an opening and an open position for opening the opening, a guiding member, a main assembly positioning portion, and a main assembly movable member movable in interrelation with movement of the openable member. The process cartridge comprises an electrophotographic photosensitive member, process means actable on the electrophotographic photosensitive member, a cartridge positioning portion, engageable with the main assembly of the electrophotographic image forming apparatus, for positioning the process cartridge relative to the main assembly, a cartridge movable member movable by movement of the main assembly movable member, when the process cartridge, upon mounting of the process cartridge to the main assembly of the apparatus through the opening while being guided by the guiding member, stops at a position upstream, with respect to a process cartridge mounting direction, of an image formation position where the cartridge positioning portion is engaged with the main assembly positioning portion, the cartridge movable member is moved by movement of the main assembly movable member to contact to the guiding member, by which the cartridge movable member receives, from the guiding member, a force for moving the process cartridge toward downstream with respect to the mounting direction.

According to another aspect of the present invention, there is provided an electrophotographic image forming apparatus for forming an image on a recording material, to which a process cartridge is detachably mountable. The apparatus comprises (i) an openable member movable between a closing for closing an opening and an open position for opening the opening, (ii) a main assembly positioning portion, (iii) a main assembly movable member movable in interrelation with movement of the openable member, and a guiding member for guiding the process cartridge. The process cartridge includes an electrophotographic photosensitive member, process means actable on the electrophotographic photosensitive member, a cartridge positioning portion, engageable with the main assembly positioning portion, for positioning the process cartridge relative to the main assembly of the electrophotographic image forming apparatus, and a cartridge movable member movable by movement of the main assembly movable member. When the process cartridge, upon mounting of the process cartridge to the main assembly of the apparatus through the opening while being guided by the guiding member, stops at a position upstream, with respect to a process cartridge mounting direction, of an image formation position where the cartridge positioning portion is engaged with the main assembly positioning portion, the cartridge movable member is moved by movement of the main assembly movable member to contact to the guiding member, by which the guiding member applies, to the cartridge movable member, a force for moving the process cartridge toward downstream with respect to the mounting direction.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the process cartridge in the first preferred embodiment of the present invention, and the electrophotographic image forming apparatus, in the first preferred embodiment, in which the process cartridge is mounted to form an image, will be described with reference to the appended drawings.

Here, an electrophotographic image forming apparatus is an apparatus which forms an image on a recording medium (for example, a sheet of a recording paper, a sheet for OHP, etc.), with the use of an electrophotographic image forming method. As examples of an electrophotographic image forming apparatus, an electrophotographic copying machine, an electrophotographic printer (for example, a laser beam printer, an LED printer, etc.), a facsimile machine, and the like can be included. A process cartridge is a cartridge having an electrophotographic photosensitive drum and at least one processing means which processes the electrophotographic photosensitive drum. As examples of a processing means, there are a charging means, a developing means, and a cleaning means. Thus, a process cartridge is, for example, a cartridge in which a charging means, a developing means or a cleaning means, and an electrophotographic photosensitive drum, are integrally disposed, and which is removably mountable in the main assembly of an electrophotographic image forming apparatus, and a cartridge in which at least one among the charging means, developing means, and cleaning means, and an electrophotographic photosensitive drum, are integrally disposed, and which is removably mountable in the main assembly of an electrophotographic image forming apparatus.

Embodiment 1

Image Forming Apparatus

Figure 1:
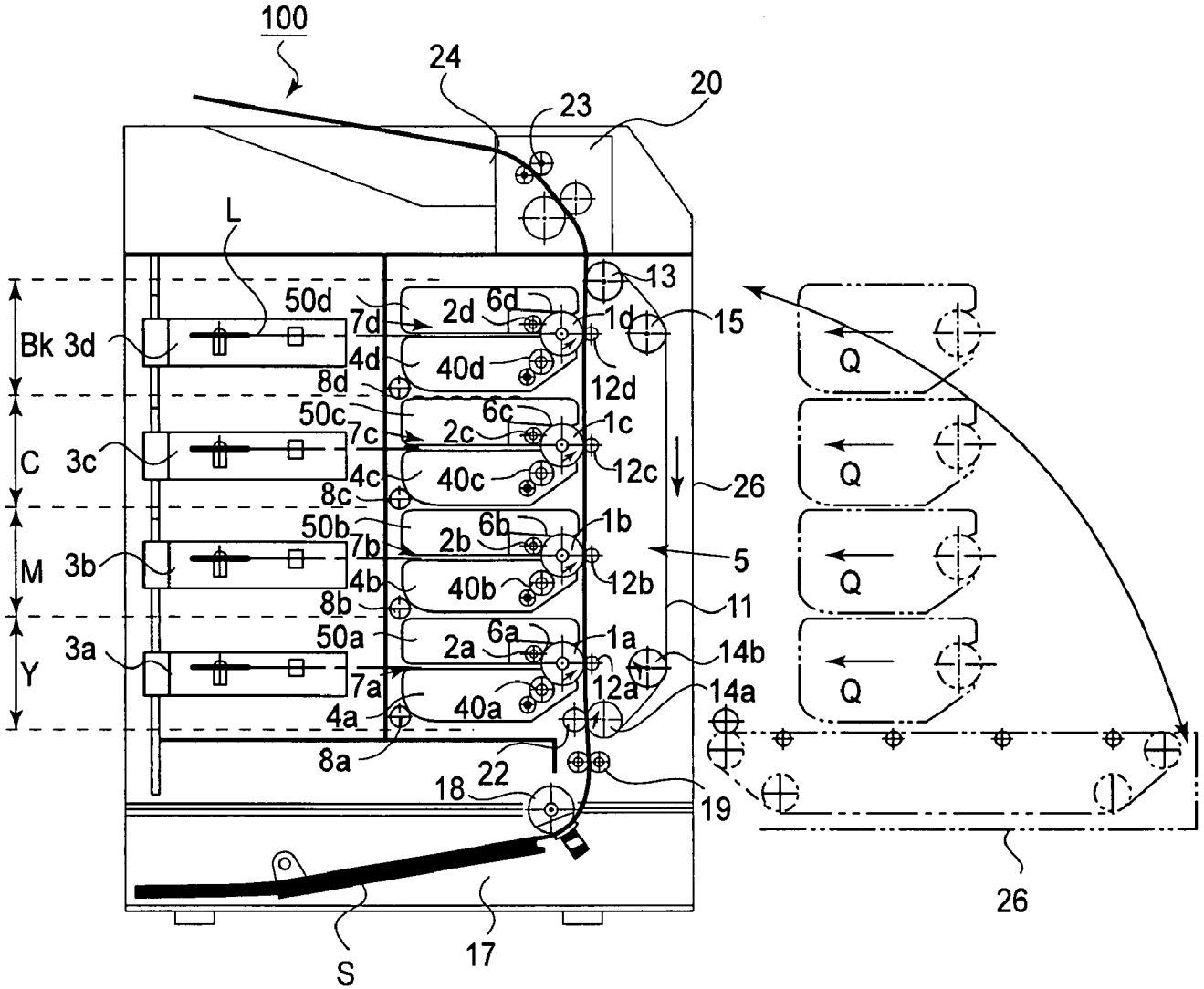
FIG. 1 is a sectional view of the electrophotographic image forming apparatus in the first of the preferred embodiments of the present invention, showing the general structure thereof.

First, referring to FIG. 1, the general structure of the electrophotographic image forming apparatus in this embodiment will be described. In FIG. 1, designated by reference symbols Y, M, C, and Bk are first to fourth image formation stations, in which four monochromatic toner images of yellow, magenta, cyan, and black colors are formed, respectively. The yellow, magenta, cyan, and black monochromatic images are the images into which an intended full-color image is optically separated. The image formation stations Y, M, C, and Bk are vertically stacked in parallel in the apparatus main assembly 100, shown from bottom to top.

In each of the image formation stations Y, M, C, and Bk, a process cartridge 7 (7*a*, 7*b*, 7*c*, 7*d*) is held, which has an electrophotographic photosensitive drum 1 (1*a*, 1*b*, 1*c*, 1*d*), a charging means 2 (2*a*, 2*b*, 2*c*, 2*d*), a development roller 40 (40*a*, 40*b*, 40*c*, 40*d*), and a cleaning means 6, and which is removably mountable into the main assembly 100 of the image forming apparatus. The electrophotographic photosensitive drum 1 (1*a*, 1*b*, 1*c*, and 1*d*) (which hereinafter will be referred to as the photosensitive drum) as an electrophotographic photosensitive member is in the form of a drum. The charging means 2 (2*a*, 2*b*, 2*c*, and 2*d*) is disposed in the adjacencies of the peripheral surface of the photosensitive drum 1 (1*a*, 1*b*, 1*c*, and 1*d*), and uniformly charges the peripheral surface of the photosensitive drum 1. The development roller 40 (40*a*, 40*b*, 40*c*, and 40*d*) is disposed in the adjacencies of the peripheral surfaces of the photosensitive drum 1, and develops the latent image formed on the photosensitive drum 1, into a visible image, with the use of the developer. The cleaning means 6 (6*a*, 6*b*, 6*c*, and 6*d*) removes the developer remaining on the photosensitive drum 1 after the developer image formed on the photosensitive drum 1 is transferred onto a sheet or a recording medium or the like.

In the rear portion of the image forming apparatus main assembly (which hereinafter will be referred to simply as the apparatus main assembly), scanner units 3 (3*a*, 3*b*, 3*c*, and 3*d*) are disposed, each of which selectively exposes the numerous points on the photosensitive drum 1 (1*a*, 1*b*, 1*c*, and 1*d*), based on the image formation information to form an electrostatic latent image on the photosensitive drum 1.

In the bottom portion of the apparatus main assembly, a cassette 17 is located, which is removably mountable into the apparatus main assembly. The cassette 17 holds one or more sheets of recording media S. Also in the bottom portion of the apparatus main assembly, a recording medium conveying means is provided, which conveys each recording medium S upward so that the recording medium S comes into contact with each photosensitive drum 1. More specifically, the bottom portion of the apparatus main assembly is provided with a feed roller 18 which feeds the recording media S into the apparatus main assembly while separating them one by one, and a pair of registration rollers 19 which convey the recording media S further into the apparatus main assembly. Located above the cassette 17 is an electrostatic transferring means 5, which transfers the toner images formed on the photosensitive drums 1 (1*a*, 1*b*, 1*c*, and 1*d*), onto the recording medium S (transfer medium). The electrostatic transferring means 5 is made up of four rollers (which are a driver roller 13, two follower rollers 14*a* and 14*b*, and a tension roller 15), and a transfer belt 11 supported by the four rollers by being stretched around them. The electrostatic transferring means 5 is structured so that the transfer belt 11 opposes all of the photosensitive drums 1 and is circularly moved in contact with all of the photosensitive drums 1. As the recording medium S is conveyed to the transfer belt 11, the recording medium S is electrostatically adhered to the transfer belt 11 by the voltage applied to the transfer belt 11 and an electrostatic adhesion roller 22. Then, the recording medium S is conveyed upward of the apparatus main assembly by the transfer belt 11 while remaining electrostatically adhered thereto.

The image formation sequence carried out by the image forming apparatus in this embodiment is as follows. Each photosensitive drum 1 is rotated, and while it is rotated, it is uniformly charged by the charging means 2. Then, the numerous points of the uniformly charged peripheral surface of the photosensitive drum 1 are selectively exposed by the scanner unit 3. As a result, an electrostatic latent image is formed on the photosensitive drum 1. This latent image is developed by the development roller 40. As a result, a monochromatic developer image is formed on the photosensitive drum 1. Incidentally, there are four image formation stations, and therefore, four monochromatic toner images different in color are formed.

In synchronism with the progression of the formation of the images on the photosensitive drums 1, a sheet of a recording medium S is conveyed to the areas in which the recording medium S is made to oppose the photosensitive drums 1. While the recording medium S is conveyed through each of the above-mentioned areas, a transfer bias is applied to a corresponding transfer roller (12*a*, 12*b*, 12*c*, and 12*d*) which opposes the photosensitive drum 1 (1*a*, 1*b*, 1*c*, and 1*d*), with the transfer belt 11 pinched between the transfer roller and photosensitive drum 1. As a result, the developer images, different in color, on the photosensitive drums 1 are transferred in layers onto the recording medium S, forming thereby a color image on the recording medium S.

After the formation of a color image on the recording medium S through the above described image formation sequence, the recording medium S and the developer images thereon are subjected to heat and pressure by a fixing portion 20. As a result, the developer images are fixed to the recording medium S. Thereafter, the recording medium S is discharged into a delivery tray 24 by a pair of discharge rollers 23. Incidentally, the fixing portion 20 is located in the top portion of the apparatus main assembly.

After the developer images are transferred onto the recording medium S, in the first to fourth image formation stations Y, M, C, and Bk, the photosensitive drums 1 are cleared of adherent substances such as the developer remaining on the photosensitive drums after the abovementioned image transfer, by the cleaning means 6. Then, the photosensitive drums 1 are used for the following image formation; the photosensitive drums are repeatedly used for image formation.

{Cartridge}

In each of the first to fourth image formation stations Y, M, C, and Bk, the photosensitive drum 1, the charging means 2, the development roller 40, and the cleaning means 6 are in the cartridge 7, making up a unit which is removably mountable in the apparatus main assembly 100. Next, the structure of the cartridge 7 will be described.

Referring to FIG. 1, each cartridge 7 in this embodiment is made up of a cleaning unit 50 (50*a*, 50*b*, 50*c*, and 50*d*) and a development unit 4 (4*a*, 4*b*, 4*c*, and 4*d*). Each cleaning unit 50 is made up of the photosensitive drum 1, the charging means 2, the cleaning means 6, and a cleaning unit frame (first frame) to which the preceding components are attached. Each development unit 4 is made up of a developing means and a development unit frame (second frame) to which the developing means is attached. The development unit 4 and the cleaning unit 50 are connected to each other so that they are pivotally movable relative to each other.

The operation for mounting each of the cartridges 7 into the apparatus main assembly 100 is as follows. First, a door 26 is to be opened to fully expose a cartridge insertion opening 91 (FIG. 8) of the apparatus main assembly 100. The apparatus main assembly 100 is structured so that the door 26 can be opened or closed against the apparatus main assembly 100 to expose or cover the cartridge insertion opening 91. The door 26 is in front of the apparatus main assembly 100.

Figure 8:
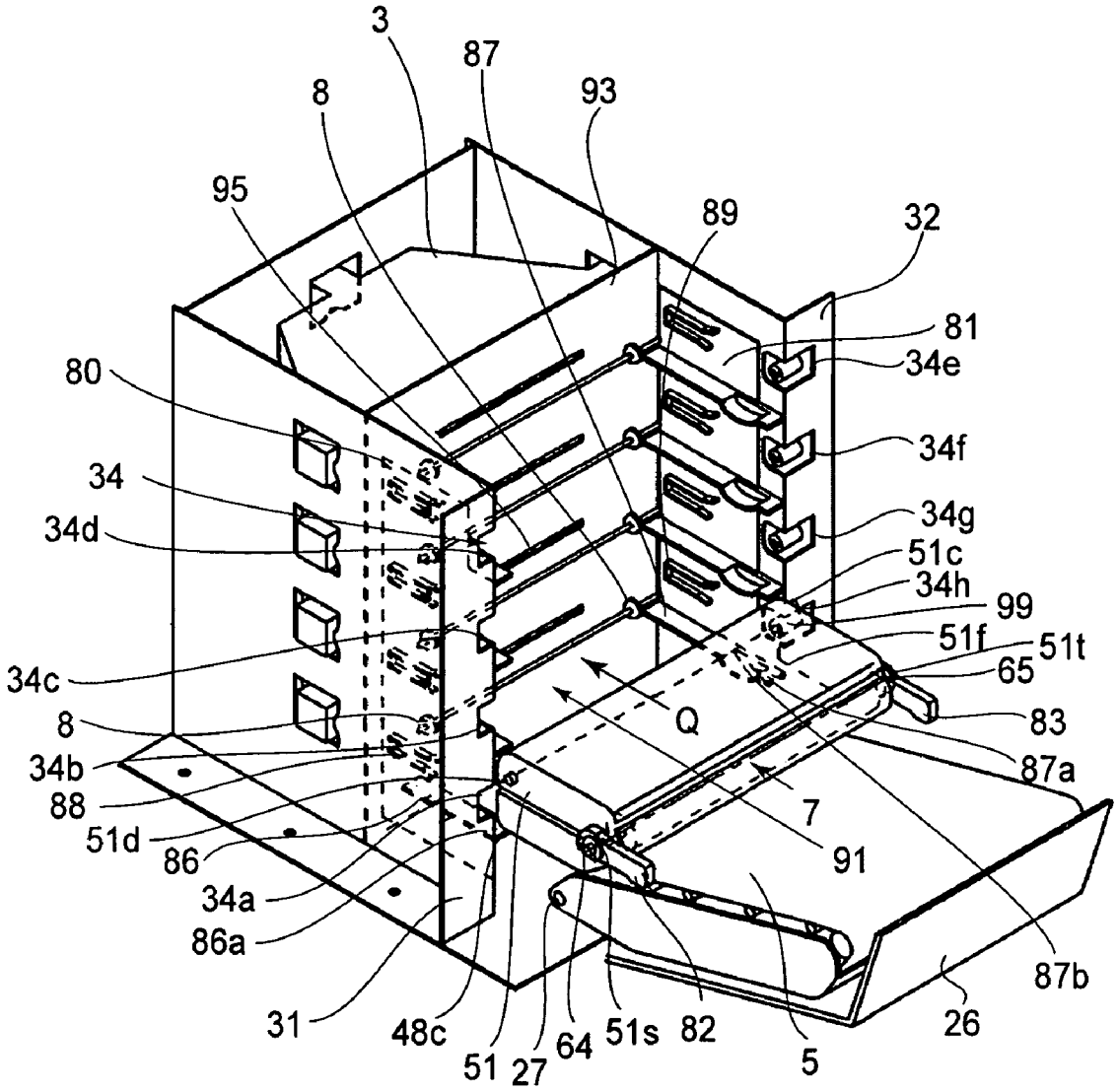
FIG. 8 is a perspective view of the main assembly of the electrophotographic image forming apparatus in the first preferred embodiment of the present invention, showing the method for mounting the cartridges into the image forming apparatus main assembly.

More specifically, the door 26 is to be rotated downward, that is, frontward of the apparatus main assembly 100, about a hinge shaft 27 (FIG. 8), that is, the shaft of a hinge located in the bottom portion of the apparatus main assembly 100, into the position outlined by a double-dot chain line in FIG. 1, or by the solid line in FIG. 8. As the door 26 is rotated down- and frontward, the abovementioned cartridge insertion opening 19 is fully exposed. The door 26 can be shut against the apparatus main assembly 100 (as outlined by solid line in FIG. 8). In other words, the door 26 makes up a front cover of the apparatus main assembly 100. In the hollow of the door 26, the electrostatic transferring means 5 is disposed.

The structural arrangement for removably mounting the cartridge 7 into the apparatus main assembly 100 will be described later in detail.

In the following description of the preferred embodiments of the present invention, the width direction of the cartridge 7, or the components which make up the cartridge 7, is the direction parallel to the direction in which the cartridge 7 is mounted into, or removed from, the apparatus main assembly. The lengthwise direction of the cartridge 7, or the components which make up the cartridge 7, is the direction perpendicular to the direction in which the cartridge 7 is mounted into, or removed from the apparatus main assembly. The rear surface of the cartridge 7 is the surface of the cartridge 7, which is the opposite surface of the cartridge 7 from the front surface of the cartridge, as seen from the front side of the apparatus main assembly. The left and right sides of the cartridge 7 are the left and right sides as seen from the front side of the apparatus main assembly. The top and bottom surfaces of the cartridge 7 are the surfaces of the cartridge 7, which are facing upward and downward, respectively, when the cartridge is correctly in the preset image forming position.

Figure 2:
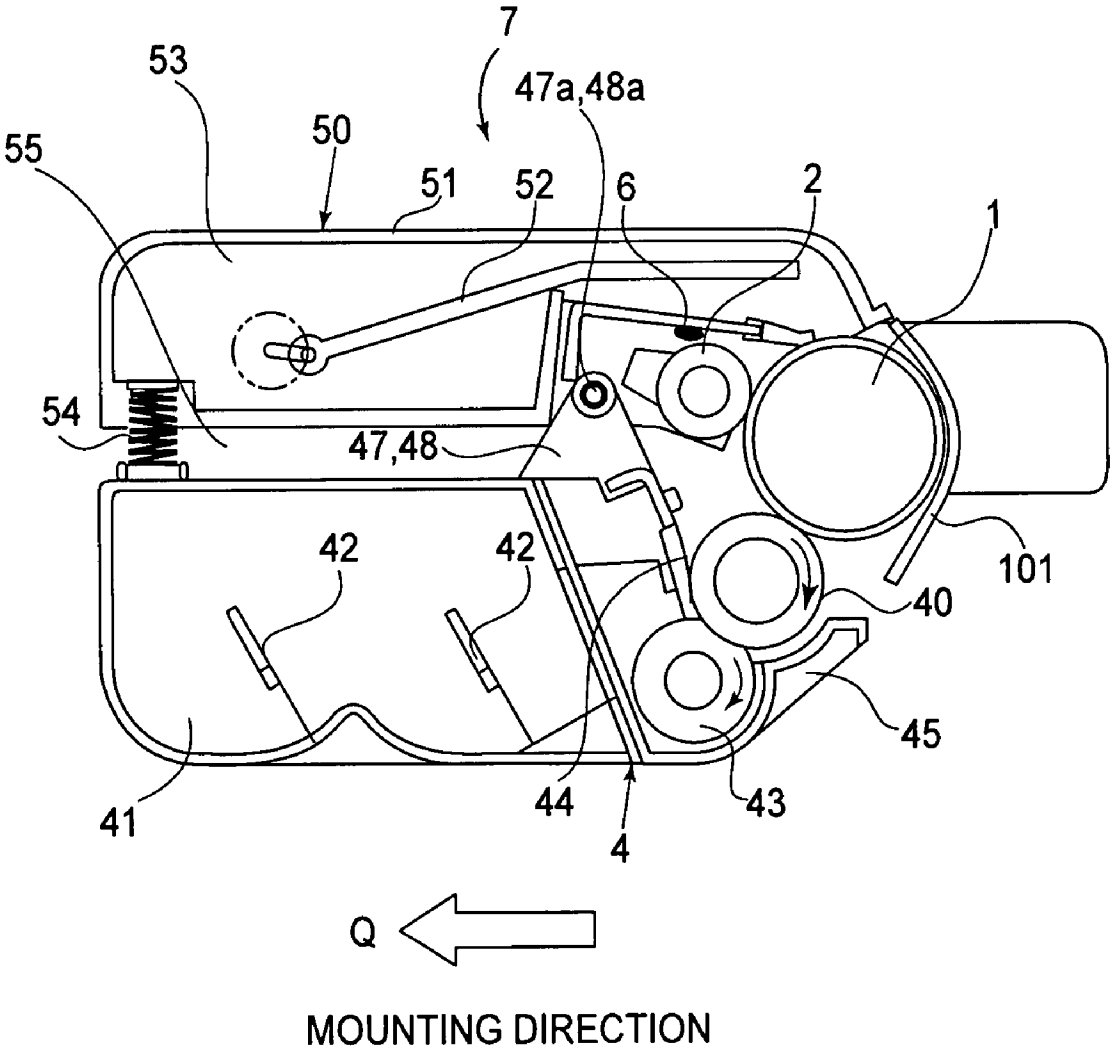
FIG. 2 is a cross-sectional view of the process cartridge in the first preferred embodiment of the present invention, showing the general structure thereof.
Figure 3:
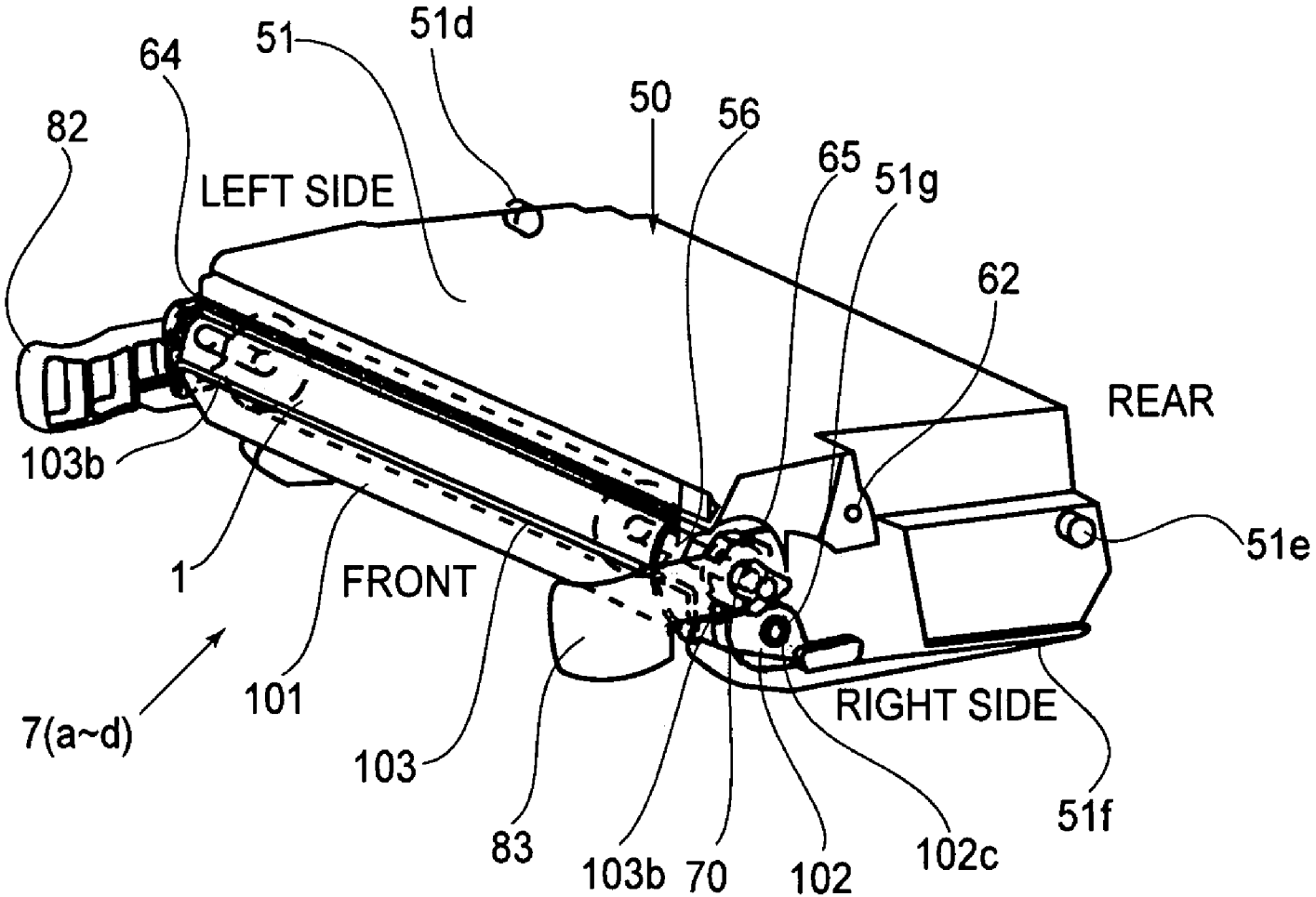
FIG. 3 is a schematic perspective view of the process cartridge in the first preferred embodiment of the present invention.
Figure 4:
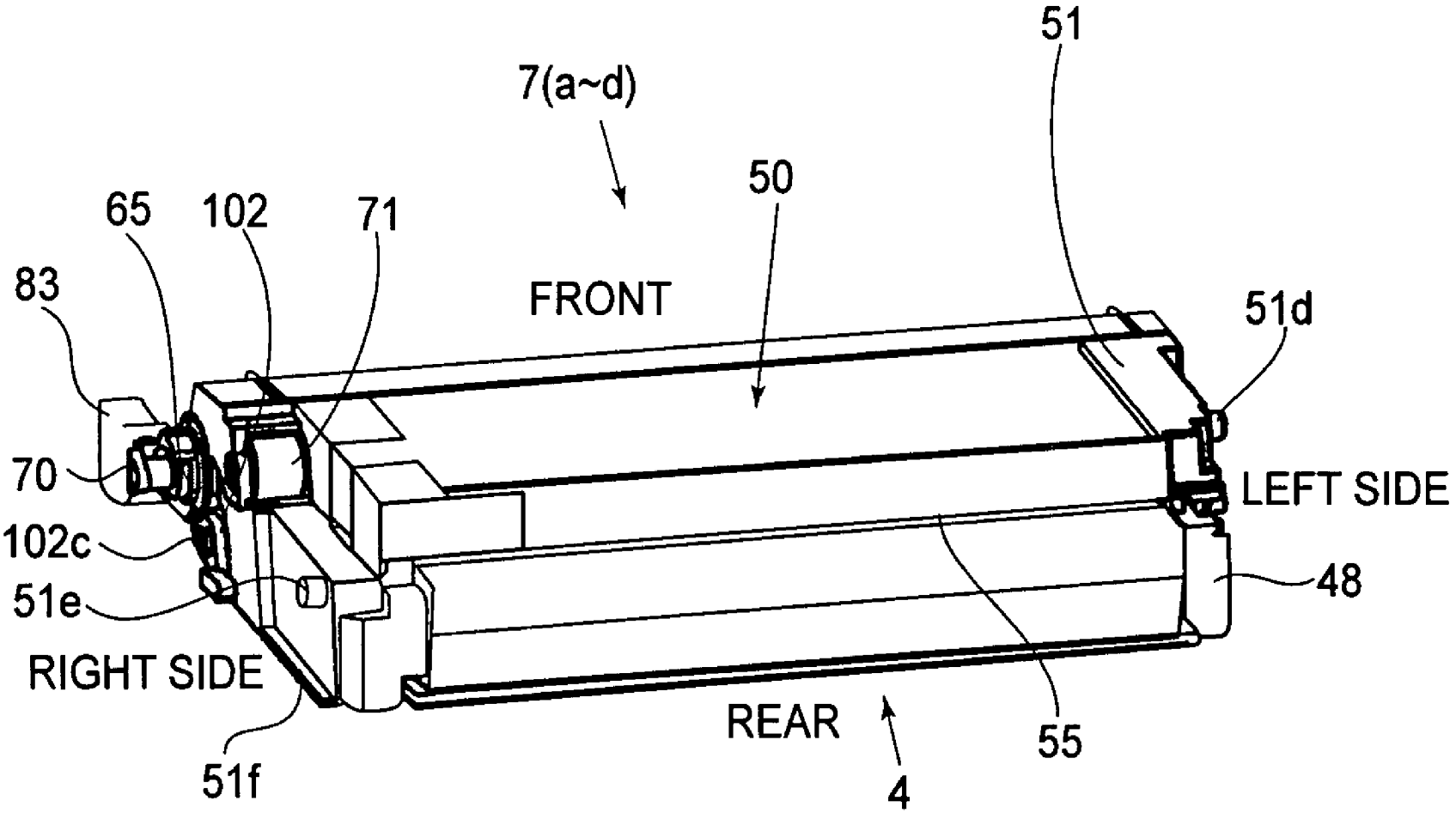
FIG. 4 is also a schematic perspective view of the process cartridge in the first preferred embodiment of the present invention.
Figure 5:
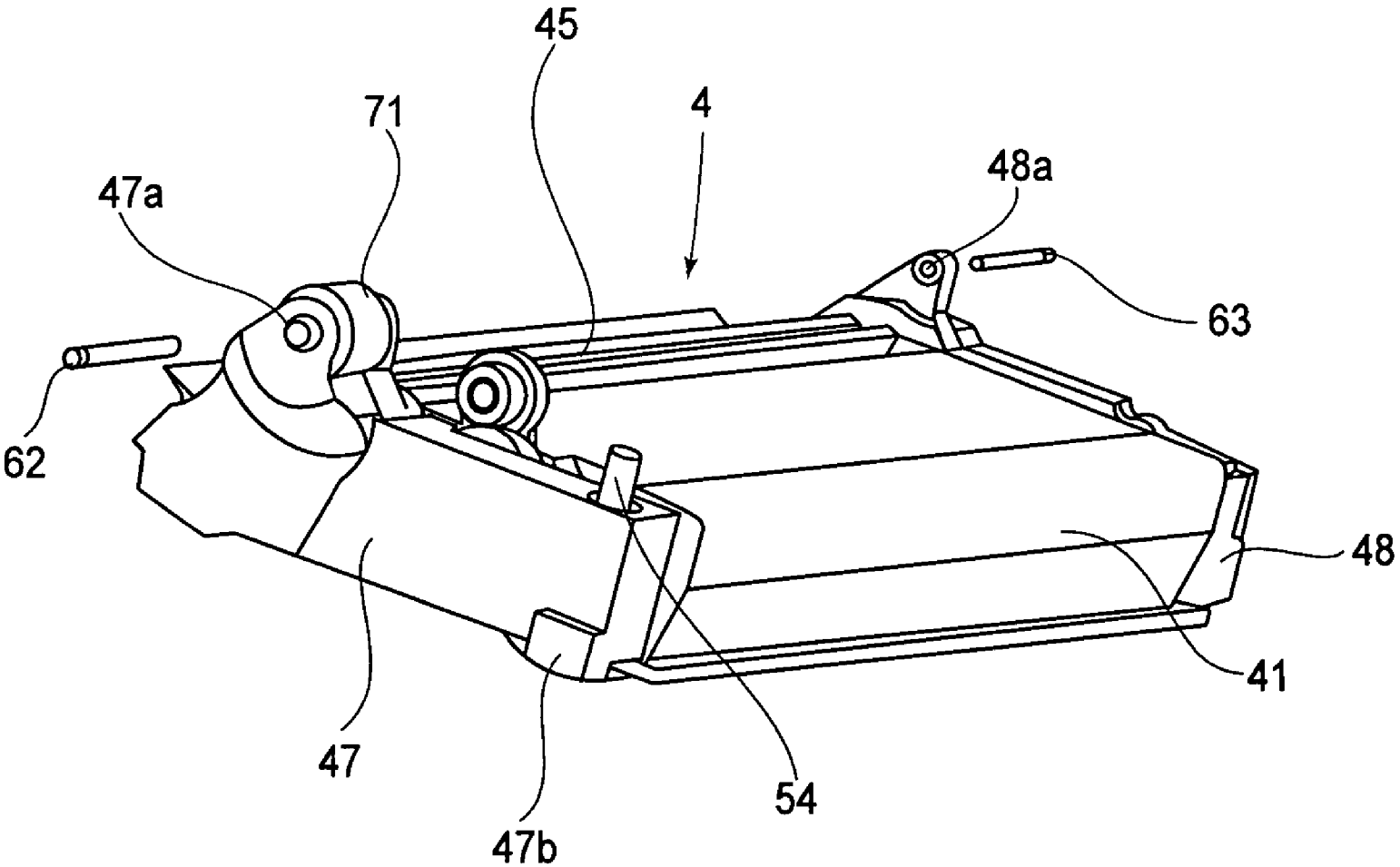
FIG. 5 is a schematic perspective view of the development unit, which is one of the units which make up the cartridge in the first preferred embodiment of the present invention.
Figure 6:
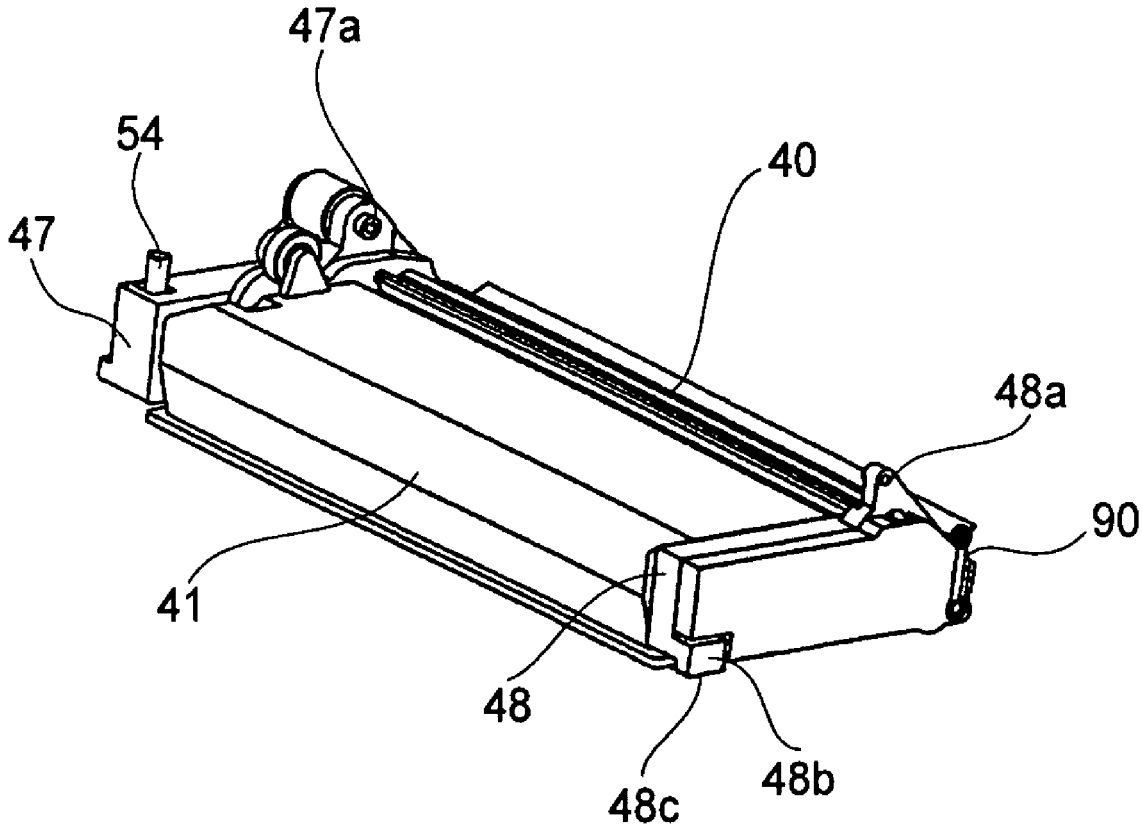
FIG. 6 is also a schematic perspective view of the development unit, which is one of the units which make up the cartridge in the first preferred embodiment of the present invention.
Figure 7:
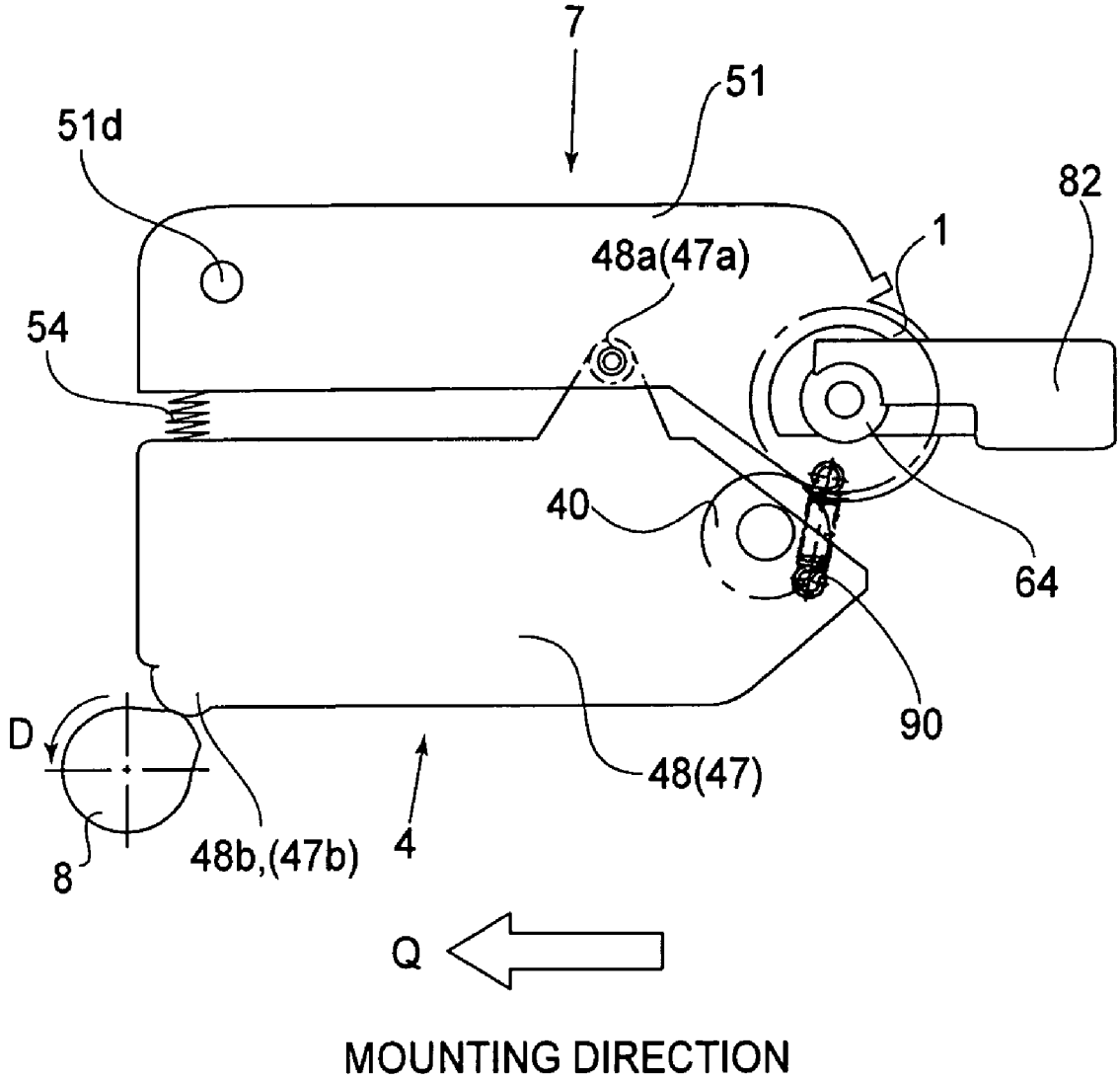
FIG. 7 is a cross-sectional view of the process cartridge in the first preferred embodiment of the present invention, showing the movement of the development unit for separating the development roller from the photosensitive drum.

FIG. 2 is a cross-sectional view of the cartridge 7. FIGS. 3 and 4 are schematic perspective views of the cartridge 7. FIGS. 5 and 6 are schematic perspective views of the development unit of the cartridge 7. FIG. 7 is a schematic cross-sectional view of the cartridge 7, showing the separation of the development roller from the photosensitive drum.

The cartridges 7 in the image formation stations Y, M, C, and Bk, one for one, are different in the color of the developer stored in the developer container of the development unit 4. That is, it is the developer of yellow color that is in the cartridge 7*a* in the first image formation station Y, and it is the developer of magenta color that is in the cartridge 7*b* in the second image formation station M. Further, it is the developer of cyan color that is in the cartridge 7*c* in the third image formation station C, and it is the developer of black color that is in the cartridge 7*d* in the fourth image formation station Bk. The cartridges 7*a*, 7*b*, 7*c*, and 7*d* are identical in structure, although they are different in the color of the developer therein.

Each cartridge 7 in this embodiment is made up of the cleaning unit 50 and development unit 4, which are connected to each other.

To the frame 51 of the cleaning unit 50, the photosensitive drum 1 is rotatably attached. In the adjacencies of the peripheral surface of the photosensitive drum 1, the abovementioned charging means 2 and cleaning means 6 are disposed. The residual developer, that is, the developer remaining on the peripheral surface of the photosensitive drum 1 after the image transfer, is removed by the cleaning means 6. The removed residual developer is sent by a developer conveyance mechanism 52 to a chamber 53 for removed developer, with which the cleaning unit frame 51 is provided. As the charging means 2, a charging means of the contact type is employed. More specifically, it is in the form of an electrically conductive roller, which is to be placed in contact with the peripheral surface of the photosensitive drum 1. With this roller placed in contact with the photosensitive drum 1, charge bias voltage is applied to the roller. As a result, the peripheral surface of the photosensitive drum 1 is uniformly charged.

The development unit 4 has a developer container 41 and a development unit frame 45. The developer in the developer container is sent by a developer conveyance mechanism 42 to a developer supply roller 43. Then, the developer is coated on the peripheral surface of the development roller 40 by the developer supply roller 43, and a development blade 44 kept pressed upon the peripheral surface of the development roller 40. The developer coated on the peripheral surface of the development roller 40 is frictionally charged by the developer supply roller 43 and development blade 44. Then, development bias is applied to the development roller 40 from the apparatus main assembly. As a result, the electrostatic latent image on the photosensitive drum 1 is developed. Incidentally, the development roller 40 and photosensitive drum 1 are positioned so that their peripheral surfaces directly oppose each other. The development roller 40 is placed in contact with the photosensitive drum 1 to develop the electrostatic latent image on the photosensitive drum 1.

Referring to FIG. 3, a drum shaft 56 is put through the photosensitive drum 1 so that the axial line of the photosensitive drum 1 coincides with that of the drum shaft 56. The drum shaft 56 is rotatably supported at the lengthwise ends by a pair of bearings 64 and 65 placed between the lengthwise ends of the drum shaft 56 and the cleaning unit frame 51. The drum shaft 56 and photosensitive drum 1 are fastened to each other so that they rotate together. To one of the lengthwise ends of the drum shaft 56, a coupling 70 is attached, to which driving force is transmitted from a motor (unshown) of the apparatus main assembly 100. As driving force is transmitted to the coupling 70, the photosensitive drum 1 is rotationally driven in the counterclockwise direction (FIG. 2). The aforementioned developer conveyance mechanism 52 in the storage chamber 53 for the removed developer is driven by the rotation of the photosensitive drum 1 through a gear train (unshown).

The bearings 64 and 65 are supported by handgrips 82 and 83, respectively, and the cleaning unit frame 51. Incidentally, the handgrips 82 and 83 are to be used when mounting the cartridge 7 into the apparatus main assembly 100. The cleaning unit frame 51 is provided with a shutter 101 for protecting the photosensitive drum 1. The shutter 101 is opened or closed by the movement of a shutter supporting member 102, that is, a movable member, which is caused to move by the movement of the cartridge 7, which occurs when the cartridge 7 is mounted into, or removed from, the apparatus main assembly 100.

The bearing 64 supports one of the lengthwise ends of the drum shaft 56 of the photosensitive drum 1, in terms of the direction parallel to the axial line of the photosensitive drum 1, and the bearing 65 supports the other lengthwise end of the drum shaft 56.

{Unit Rotating Structure}

The development unit 4 is attached to the cleaning unit 50 so that it can be pivotally moved in its entirety relative to the cleaning unit 50. More specifically, referring to FIGS. 5 and 6, the development unit 4 is provided with a pair of bearing members 47 and 48, which are attached to the lengthwise ends of the development unit 4, one for one. The bearing members 47 and 48 are provided with holes 47*a* and 48*a*, about the axial lines of which the development unit 4 rotates. Through these holes 47*a* and 48*a*, connective pins 62 and 63 are put, connecting thereby the development unit 4 to the cleaning unit 50 so that the development unit 4 is allowed to pivotally move relative to the cleaning unit 50.

When the cartridge 7 is out of the apparatus main assembly 100, the development roller 40 is kept in contact with photosensitive drum 1 by the moment generated in the direction to rotate the development unit 4 about the connective pins 62 and 63. More specifically, referring to FIGS. 5 and 6, the cartridge 7 is provided with a compression spring 54 as an elastic member for pressing the development unit 4. The compression spring 54 is disposed between the cleaning unit 50 and development unit 4. The compression spring 54 is located on the same lengthwise end of the cartridge 7 as the bearing member 47. Further, the cartridge 7 is provided with a tension spring 90 as a pressure applying member. The tension spring 90 is also disposed between the cleaning unit 50 and development unit 4. The tension spring 90, however, is located on the same lengthwise end of the cartridge 7 as the bearing member 48.

Referring to FIGS. 5 and 6, the bearing members 47 and 48 are provided with force bearing portions 47*b* and 48*b*, which are integral parts of the bearing members 47 and 48, respectively. These force bearing portions 47*b* and 48*b* are where cams 8 (FIG. 7) come into contact and press, one for one, to separate the development roller 40 from the photosensitive drum 1. Each cam 8 is a part of the printer main assembly 100, and is the means for separating the development roller 40 from the photosensitive drum 1.

Referring to FIG. 7, in terms of a direction Q, that is, the direction in which the cartridge 7 is to be mounted into the apparatus main assembly 100, the aforementioned bearing member holes 47*a* and 48*b*, about the axial lines of which the development unit 4 rotates, are between the development roller 40 and force bearing portion 48*b* (47*b*).

With the cartridge 7 and apparatus main assembly 100 structured as described above, as the cartridge 7 is inserted into the apparatus main assembly 100, first, the force bearing portions 47*b* and 48*b* are caused to slide onto the aforementioned cams 8. As a result, the development roller 40 is separated from the photosensitive drum 1, and is kept separated until the cams 8 are rotated. In other words, while the cartridge 7 is in the apparatus main assembly 100, the development roller 40 can be kept separated from the photosensitive drum 1 with the employment of a simple structural arrangement. As the time comes for image formation, the cams 8 as the cartridge pressing members are to be rotated to allow the force generated by the compression spring 54 and tension spring 90 to pivotally move the development unit 4 in the direction to cause the development roller 40 to be pressed upon the photosensitive drum 1 so that it becomes possible for the photosensitive drum 1 to be supplied with developer.

When the time comes for re-separating the development roller 40 from the photosensitive drum 1, the cams 8 are to be rotated in the direction indicated by an arrow D in FIG. 7 in order to cause the cams 8 to press upward the force bearing portions 47*b* and 48*b*. As the force bearing portions 47*b* and 48*b* are pushed upward, the development roller 40 becomes separated from the photosensitive drum 1 by a preset distance. Incidentally, the force bearing portions 47*b* and 48*b* are parts of the development unit 4.

The development method employed by the image forming apparatus in this embodiment is of the contact type, in which the photosensitive drum 1 and development roller 40 are placed in contact with each other to develop a latent image on the photosensitive drum 1. Thus, it is desired that the photosensitive drum 1 is rigid, whereas the development roller 40 is elastic. More specifically, the development roller 40 is desired to have an elastic layer. As for the material for the elastic layer, solid rubber or the like may be used. However, in consideration of one of the functions required of the development roller 40, which is to charge developer, the peripheral surface of the elastic layer, for example, a solid rubber layer, is coated with resin.

{Structure for Transmitting Driving Force to Cartridge}

Referring to FIGS. 4 and 6, the development unit 4 is provided with a cartridge driving gear 71 (helical gear), as a development roller driving force receiving portion, which receives the force for rotating the development roller 40, from the apparatus main assembly 100. As the cartridge 7 is mounted into the apparatus main assembly 100, the gear 71 meshes with a development roller driving gear (a helical gear and unshown), with which the apparatus main assembly 100 is provided; when the cartridge 7 is correctly positioned in the image formation position in the apparatus main assembly 100, the gear 71 remains meshed with the development roller driving gear of the apparatus main assembly 100, and receives the development roller driving force from the development roller driving gear. As the gear 71 rotates, the development roller 40, the developer conveyance mechanism 42, and the developer supply roller 43 are driven by the gear 71 through a gear train (unshown). Incidentally, the gear 71 is attached to one of the lengthwise ends of the photosensitive drum 1.

To the opposite lengthwise end of the drum shaft 56 from the gear 71, a coupling 70, as a driving force receiving portion of the cartridge side, is attached, which receives the force for driving the photosensitive drum 1. In other words, the coupling 70 is attached to one of the lengthwise ends of the photosensitive drum 1. As the cartridge 7 is inserted into the apparatus main assembly 100, the coupling 70 engages with the coupling 99 (FIG. 8) of the apparatus main assembly 100; when the cartridge 7 is correctly positioned in the image formation position in the apparatus main assembly 100, the coupling 70 remains engaged with the coupling 99 of the apparatus main assembly 100, and receives the driving force from the coupling 99, rotating thereby the photosensitive drum 1.

{Cartridge Bays}

Next, referring to FIGS. 8 and 9, the operation for mounting the cartridge 7 into the apparatus main assembly 100 will be described.

Referring mainly to FIG. 8, the operation for mounting each of the cartridges 7 into the apparatus main assembly 100, or removing each of the cartridges 7 from the apparatus main assembly 100, is carried out, with the front door 26 of the apparatus main assembly 100 wide open, that is, with the cartridge insertion opening 91 fully exposed. More specifically, when the front door 26 is in the closed state, it is kept locked to the apparatus main assembly 100 by a latching mechanism (unshown). As the front door 26 is unlocked by unlatching the latching mechanism, the front door 26, in the hollow of which the electrostatic transferring means 5 is located, can be rotated down and frontward of apparatus main assembly 100 about the hinge shaft 27 located at the bottom end of the door 26. As the front door 26 is rotated down and frontward all the way, the cartridge insertion opening 91 is fully exposed.

Each of the cartridge bays of the apparatus main assembly 100 is provided with a pair of cartridge guides 80 and 81 for guiding the cartridge 7 into the image formation position. The cartridge guides 80 and 81 are attached to the inward surfaces of the lateral plates 31 and 32 of the apparatus main assembly 100, and extend inward of the cartridge bay from the cartridge insertion opening 91. The cartridge insertion opening 91 is wide enough to expose all of the four cartridge bays, which are the cartridge bay for the cartridge 7 for forming a yellow toner image, the cartridge bay for the cartridge 7 for forming a magenta toner image, the cartridge bay for the cartridge 7 for forming a cyan toner image, and the cartridge bay 7 for forming a black toner image, listing from the bottom side.

In terms of the structure of the cartridge mounting mechanism, the four cartridge bays are identical. Here, therefore, the structure of the cartridge mechanism will be described with reference to the operation of mounting the cartridge 7 for forming a yellow toner image into the cartridge bay, that is, the bottommost cartridge bay, through the cartridge insertion opening 91.

First, the left and right handgrips 82 and 83 of the cartridge 7, which are located at the lengthwise ends of the cartridge 7, are to be gripped by the left and right hands, respectively. Then, the cartridge 7 is to be inserted into the cartridge bay in the direction indicated by the arrow Q, from the back side of the cartridge 7, that is, the opposite side from the photosensitive drum 1.

The cartridge guides 80 and 81 of the apparatus main assembly 100 are provided with guiding members 86 and 87, which support the cartridge 7 by the bottom surfaces of the lengthwise end portions of the cartridge 7. Thus, the cartridge 7 is to be inserted so that the bottom surface 48*c* of the bearing member 48 of the cartridge 7, and the bottom surface 51*f* of the cleaning unit frame 51, rest on the entrance portions 86*a* and 87*a* of the guiding members 86 and 87. Then, while the cartridge 7 is inserted further in the direction indicated by the arrow Q, the cartridge 7 remains resting on the guiding members 86 and 87.

Further, the cartridge guides 80 and 81 are provided with boss guides 88 and 89, and the lengthwise end surfaces of the cleaning unit frame 51 of the cartridge 7 are provided with bosses 51*d* and 51*e*, one for one. These bosses 51*d* and 51*e* engage into the boss guides 88 and 89, regulating thereby the rotation of the cartridge 7 in the apparatus main assembly 100.

As the cartridge 7 is further inserted, the bosses 51*d* and 51*e* begin to slide into the boss guides 88 and 89. Thus, thereafter, the cartridge 7 is guided into the image formation position while being separated from guides 80 and 81 of the apparatus main assembly 100.

The apparatus main assembly 100 is provided with a mid plate 93, which is disposed between the lateral plates 31 and 32. The mid plate 93 is provided with windows 95 which allow the beams of laser light L projected from the scanners 3 to reach the photosensitive drums 1. The cams 8 are connected to a motor (unshown) located in the apparatus main assembly 100. As the cams 8 are rotated by the motor, they allow the development rollers 40 to come into contact with the photosensitive drums 1, or separate the development roller 40*s* from the photosensitive drums 1.

As for the positioning of the cartridge 7 in the apparatus main assembly 100, in terms of the width direction of the cartridge 7, the cartridge 7 is inserted into the apparatus main assembly 100, with the bearings 64 and 65, which support the photosensitive drum 1, inserted in guiding grooves 34 (34*a*-34*h*) which are the cartridge positioning portions on the apparatus main assembly side. More specifically, referring to FIG. 9, as the bearings 64 and 65 as the cartridge positioning portion on the cartridge side are pressed upon force bearing surfaces 37 and 38 of the guiding grooves 34, the cartridge 7 becomes fixed in position relative to the apparatus main assembly 100 in terms of the width direction of the cartridge 7. This position is the image formation position of the cartridge 7. When the cartridge 7 is in this position in the apparatus main assembly 100, the bearings 64 and 65 are in the guiding grooves 34, being thereby accurately positioned, and the bosses 51*d* and 51*e* on the lengthwise end surfaces of the cleaning unit frame 51 are in contact with the boss guides 88 and 89, respectively, being thereby fixed in position.

Further, the driver gear 71 of the cartridge 7 is meshed with the development roller driving gear (unshown) of the apparatus main assembly 100.

The sequences for mounting the cartridges 7*b*, 7*c*, and 7*d*, which contain magenta, cyan, and black toners, into the corresponding cartridge bays, respectively, are the same as the above described sequence for mounting the cartridge 7*a*, or the cartridge which contains yellow toner, into the cartridge bay for the cartridge 7*a*.

After the insertion of the cartridges 7, the front door 26 is to be completely closed against the apparatus main assembly 100, and then, the front door 26 is to be locked to the apparatus main assembly 1 by the latching mechanism (unshown). It should be noted here that the following operations are carried out by the means, the movement of which is mechanically linked to the closing movement of the front door 26:

1) the operation to apply pressure to the cartridge 7 in order to correctly position the cartridge 7 in the apparatus main assembly 100, in terms of the width direction of the cartridge 7;

2) the operation to move the shutter 101 of each cartridge 7 into the open position; and 3) the operation to engage the coupling 70 of each cartridge 7 with the corresponding coupling 99 of the apparatus main assembly 100.

(Positioning of Cartridge in Terms of Width Direction)

Figure 9:
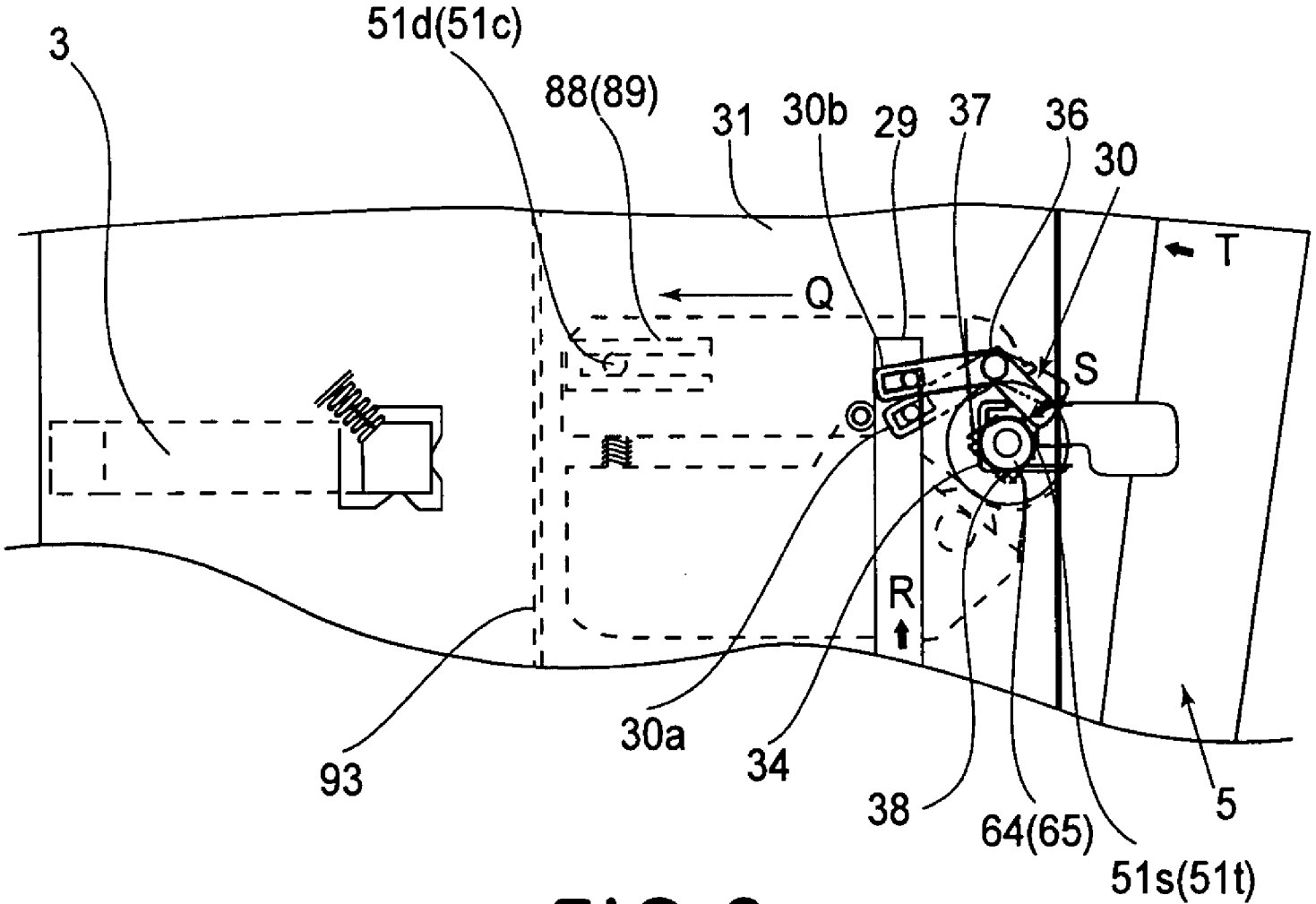
FIG. 9 is a schematic side view of the cartridge positioning mechanism for accurately positioning the cartridge, in terms of the width direction of the cartridge, in the image forming apparatus main assembly.

Referring to FIG. 9, the operation 1) to apply pressure to the cartridge 7 in order to accurately position the cartridge 7 in the apparatus main assembly 100 in terms of the width direction is carried out by a pressing member 30, the movement of which is mechanically linked to the mechanism for allowing the front door 26 (inclusive of electrostatic transferring means 5 disposed in hollow of front door 26) to be opened or closed. More specifically, the pressing member 30 is rotatably attached to a shaft 36, which is attached to the lateral plate 31 by crimping. Further, the pressing member 30 is connected to a connective member 29, the movement of which is mechanically linked to the opening and closing movement of the front door 26. When the front door 26 is in the open position, that is, when the apparatus main assembly 100 is in the state which allows the cartridges 7 to be mounted into, or removed from, the apparatus main assembly 100, the pressing member 30 is in a position 30*a* shown in FIG. 9. The position 30*a* is the position into which the pressing member 30 is retracted. Thus, while the cartridge 7 is inserted, the pressing member 30 does not contact the cartridge 7. As the front door 26 is moved in the direction (indicated by arrow T) to be closed after the cartridge insertion, the connective member 29 is moved in the direction indicated by an arrow R. Thus, the pressing member 30 is moved by this movement of the connective member 29 into a position 30*b* shown in FIG. 9, while pressing on the slanted surface 51*s* (51*t*) of the cleaning unit frame 51, which is in the adjacencies of the bearing 64 (65), in the direction indicated by an arrow mark S.

As a result, the cartridge 7 is correctly positioned in the apparatus main assembly 100, in terms of the width direction. Further, a mechanism similar to the above described mechanism is provided on the lateral plate 32 side of the cartridge 7 so that the cartridge 7 is pressed by the pressing members 30 at both lengthwise ends, one for one.

(Movement of Shutter into Open Position)

Figure 10:
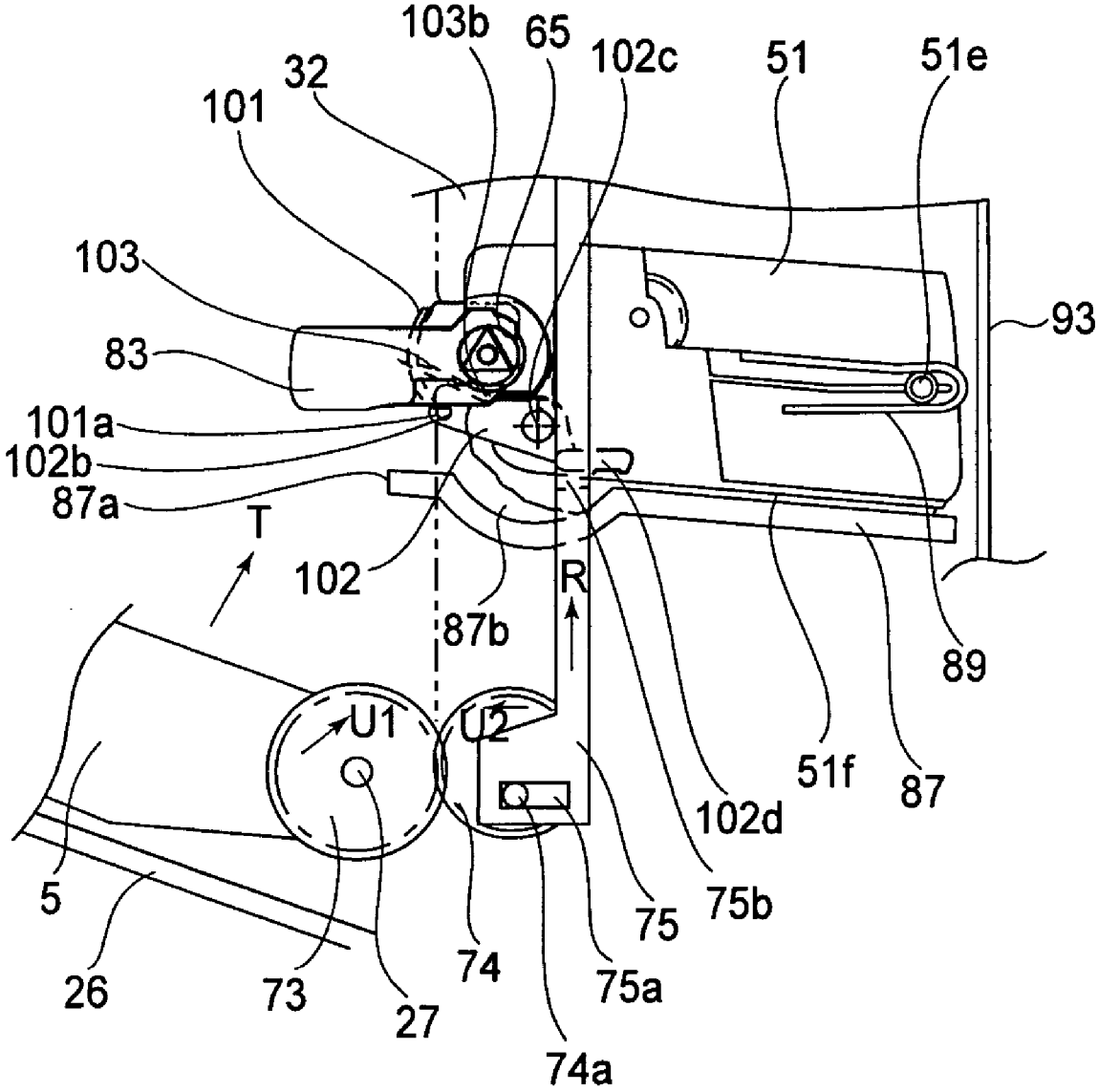
FIG. 10 is a schematic side view of the mechanism, in the first preferred embodiment of the present invention, for opening or closing the shutter of the cartridge, in the image forming apparatus main assembly.

The above described operation 2), that is, the operation for moving the shutter 101 of the cartridge 7 into the open position, is carried out by the closing movement of the front door 26, which is opened or closed relative to the apparatus main assembly 100. The electrostatic transferring means 5 is closed against the apparatus main assembly 100 by the closing movement of the front door 26. Referring to FIG. 10, the door 26 and the electrostatic transferring means 5 can be rotationally closed about the hinge shaft 27, which is attached to the bottom end of the transferring means 5. This rotational movement of the front door 26 and electrostatic transferring means 5 causes the hinge gear 73, which is attached to the hinge shaft 27, to be rotated in the direction indicated by an arrow U1. As a result, a gear 74 meshed with the hinge gear 73 is rotated in the direction indicated by an arrow mark U2.

Designated by a reference symbol 75 is a member for moving a shutter supporting member 102. This member 75 for moving the shutter supporting member is a shutter supporting member moving member of the main assembly side, and is designed to be moved by the rotation of the gear 74. More specifically, the gear 74 is provided with a boss 74*a*, which is fitted in the rectangular hole 75*a* of the member 75, being allowed to move in the rectangular hole 75*a*. Thus, as the hinge gear 73 is rotated by the closing movement of the main assembly door 26 (in direction indicated by arrow mark T), the gear 74 is rotated by the hinge gear 73, and the rotation of the gear 74 causes the shutter supporting member moving member 75 to move upward (direction indicated by arrow R).

The shutter supporting member 102 is a member for opening or closing the shutter 101, and is provided with an arm portion 102*d*. The member 75 for moving the shutter supporting member 102 is provided with four portions 75*b*, each of which is for moving the corresponding shutter supporting member 102. Thus, as the member 75 is moved upward, each portion 75*b* comes into contact with the arm portion 102*d*, and moves the shutter supporting member 102. The four portions 75*b* for moving the shutter supporting member 102 are positioned so that their positions (unshown) correspond to those of the cartridges 7, one for one.

As the member 75 for moving the cartridge supporting member 102 is moved upward, each of the portions 75*b* comes into contact with the arm portion 102*d* of the shutter supporting member 102, and causes the shutter supporting member 102 to rotate about the axial line of the hole 102*c* of the shutter supporting member 102. The lateral surface of the cleaning unit frame 51 is provided with a boss 51*g* (FIG. 3), which is fitted in the hole 102*c* of the shutter supporting member 102, allowing thereby the shutter supporting member 102 to rotate about the axial line of the hole 102*c* (boss 51*g*).

The shutter 101 is opened or closed through a mechanical linkage. More specifically, the shutter 101 is provided with a boss 101*a*, and the boss 101*a* is fitted in the hole 102*b* of the shutter supporting member 102 (as first member of linkage), allowing the shutter supporting member 102 to rotate. To the shutter 101, a shutter rod 103 (as second member of linkage) is rotatably attached. The shutter rod 103 is rotatably supported at the lengthwise end portions 103*b* by the cleaning unit frame 51. The shutter 101 is opened or closed by the coordinative movements of the shutter supporting member 102 (as first member of linkage) and shutter rod 103 (as second member of linkage) (FIG. 3).

Figure 11:
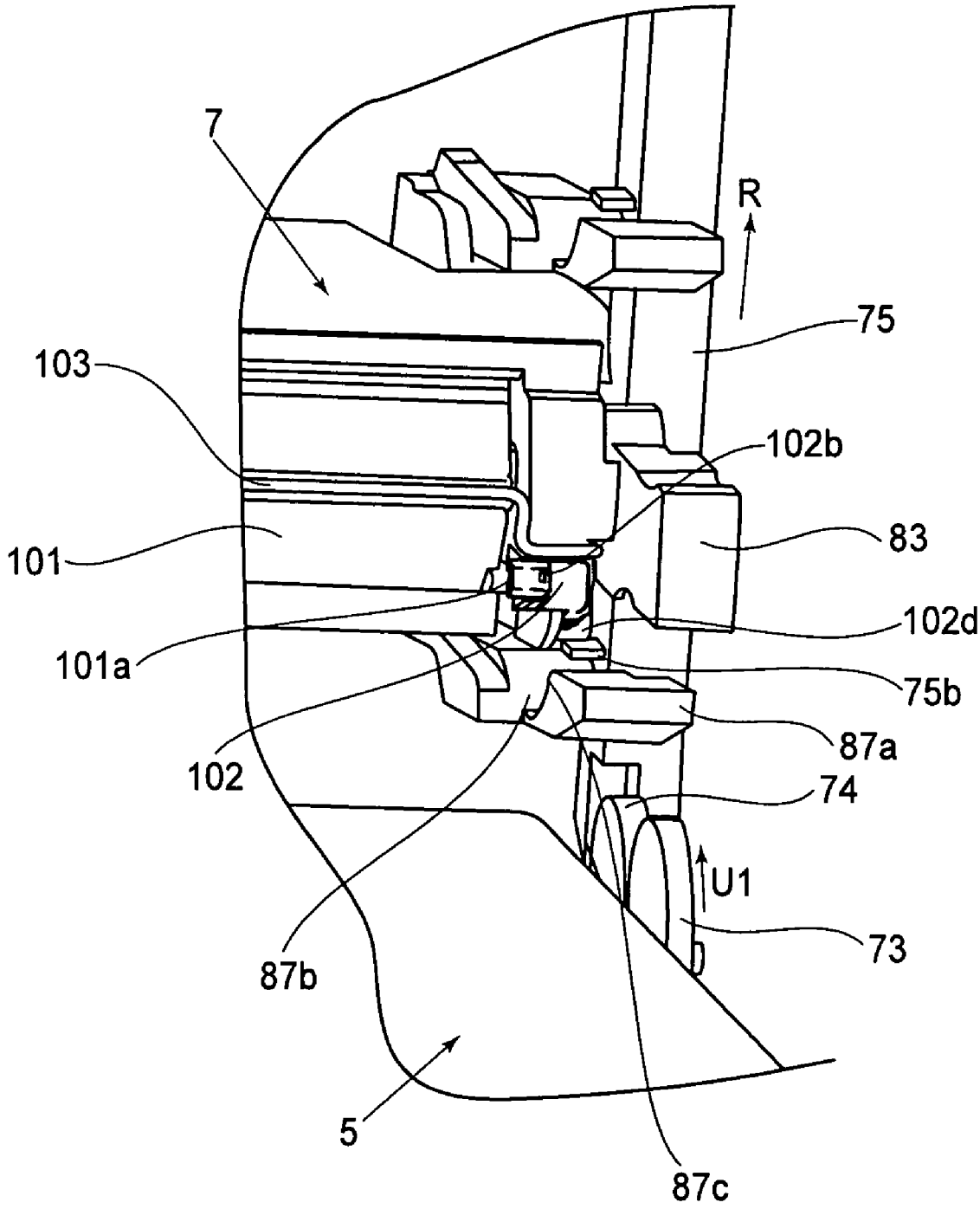
FIG. 11 is a schematic perspective view of the mechanism, in the first preferred embodiment of the present invention, for opening or closing the shutter of the cartridge, in the image forming apparatus main assembly.
Figure 12:
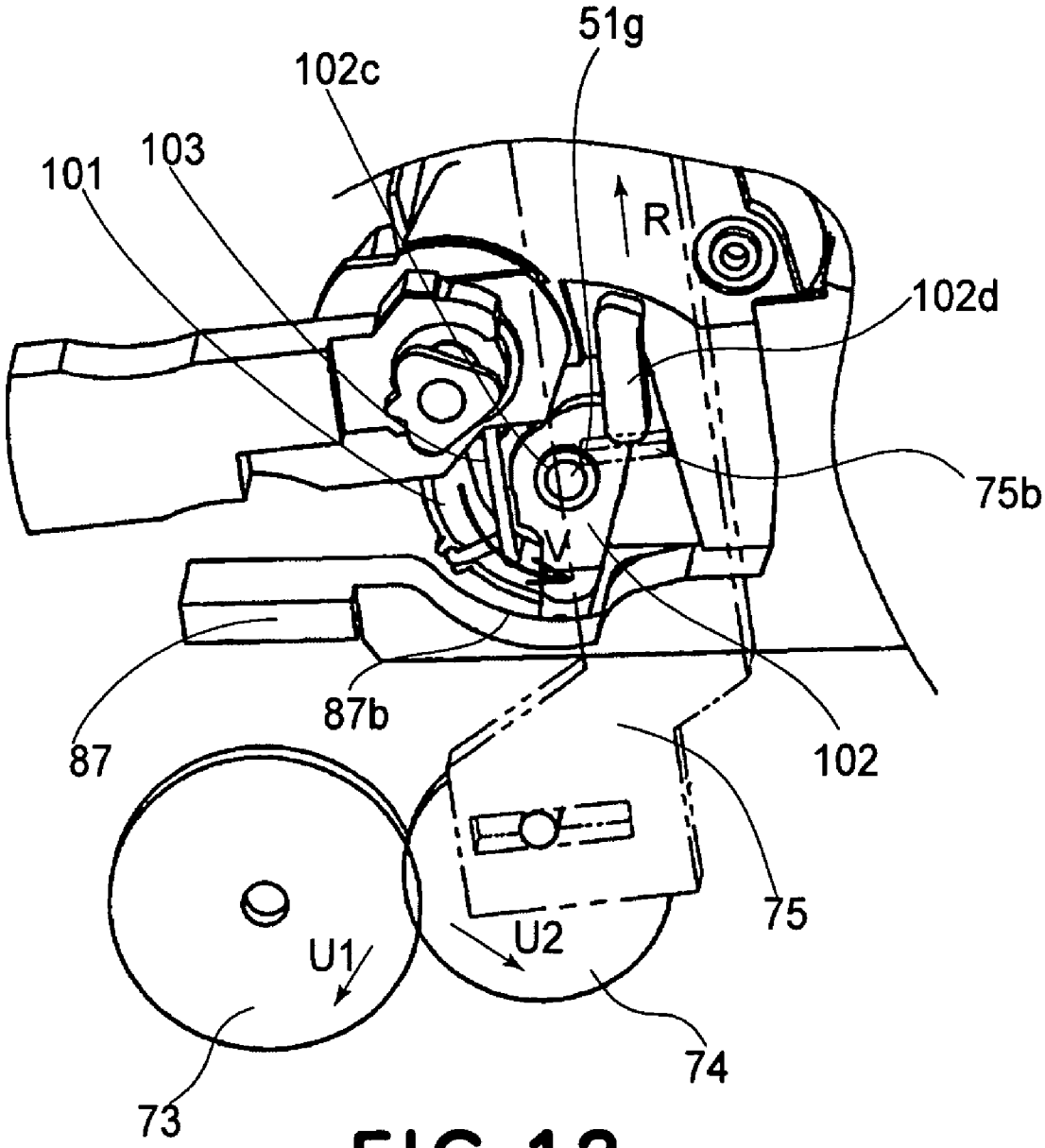
FIG. 12 is a schematic perspective view of the mechanism, in the first preferred embodiment of the present invention, for opening or closing the shutter of the cartridge in the image forming apparatus main assembly, as seen from a different angle from FIG. 11.

Referring to FIG. 11, the guiding member 87 for guiding the cartridge 7 when the cartridge 7 is mounted or removed is provided with a recess 87*b* for preventing the guiding member 87 from coming into contact with the shutter supporting member 102 when the shutter supporting member 102 rotates. Referring to FIG. 12, as the hinge gear 73 rotates in the direction indicated by the arrow U1, the gear 74 is rotated by the hinge bear 73 in the direction indicated by the arrow U2. As a result, the member 75 for moving the cartridge supporting member 102 is moved upward as indicated by the arrow R, causing each of the portions 75*b* of the member 75 to come into contact with the arm portion 102*d* of the corresponding shutter supporting member 102, and rotate the shutter supporting member 102 in the direction indicated by an arrow V, causing thereby the shutter 101 to move into the open position. During this rotation of the shutter supporting member 102 in the arrow V direction, the shutter supporting member 102 does not come into contact with the guiding member 87, because the guiding member is provided with the recess 87*b*. In other words, when the shutter of the cartridge 7 is opened while the cartridge 7 is in the image formation position, the shutter supporting member 102 is allowed to rotate without coming into contact with the guiding member 87. Therefore, the provision of the guiding member 87 does not increase the amount of force necessary to close the front door 26 after the insertion of the cartridges 7 into their correct positions in the apparatus main assembly 100.

As the front door 26 is closed, the member 75 for moving the shutter supporting member 102 is moved by the closing movement of the front door 26 so that the shutter 101 is fully opened before the front door 26 is completely closed. As the front door 26 and electrostatic transferring member 5 are tightly locked to the apparatus main assembly 100, the transfer belt 11 is placed in contact with the exposed area of the peripheral surface of the photosensitive drum 1 of each cartridge 7 (FIG. 1).

(Engagement Between Coupling of Cartridge and Coupling of Apparatus Main Assembly)

Regarding the above described operation 3), the coupling 99, that is, the coupling on the main assembly side, is moved by the closing movement of the front door 26 toward the coupling 70, that is, the coupling on the cartridge side, in the direction parallel to their rotational axes. Then, as driving force is transmitted to the coupling 99 from the motor (unshown) on the main assembly side after the satisfactory mounting of the cartridges 7 into the apparatus main assembly 100, the coupling 99 rotates, thereby engaging with the coupling 70. As a result, the driving force is transmitted to the coupling 70, causing the photosensitive drum 1 of each cartridge 7 to rotate in the counterclockwise direction of FIG. 1. This rotation of the photosensitive drum 1 rotationally drives the developer conveyance mechanism (toner sending mechanism) 52 in the chamber 53 for the removed toner, through the unshown gear train.

Since the cartridge driving gear 71 of each cartridge 7 remains meshed with the corresponding development roller driving gear (unshown) on the main assembly side, the cartridge driving gear 71 can rotate by receiving a driving force from the development roller driving gear on the main assembly side. Thus, the development roller 40, the developer conveyance mechanism (toner conveyance mechanism) 42, and toner supply roller 43 in each cartridge 7 can be rotated by this rotation of the cartridge driving gear 71, through the unshown gear train.

The beam of laser light L outputted by each scanner unit 3 is transmitted through the exposure window 95 of the mid plate 93, and enters the exposure gap 55 (FIGS. 2 and 4) provided between the cleaning unit 50 and development unit 4 of the cartridge 7.

As for the removal of the cartridge 7 from within the apparatus main assembly 100, the cartridge 7 can be removed from the apparatus main assembly 100 by following in reverse the sequence for mounting the cartridge 7 into the apparatus main assembly 100. That is, first, the front door 26 is to be unlocked from the apparatus main assembly 100 by unlatching the unshown latching mechanism. Then, the front door 26, which is inclusive of the electrostatic transferring means 5, is to be opened down and frontward of the apparatus main assembly 100 about the hinge shaft 27 located at the bottom end of the front door 26. As the front door 26 is opened, each cartridge 7 is freed from the hold of the pressing member 30 by the means, the movement of which is mechanically linked to the opening movement of the front door 26, and also, the coupling 70 of each cartridge 7 is disengaged from the coupling 99 on the main assembly side. Further, the shutter 101 of each cartridge 7 is moved into the closed position. As a result, the state in which the cartridges 7 can be removed from the apparatus main assembly 100 is realized. In this state, any of the cartridges 7 can be removed from the apparatus main assembly 100 by pulling the cartridge 7 in the opposite direction from the cartridge mounting direction, by gripping the left and right handgrips of the cartridge 7 with the left and right hands.

{Positioning of Incompletely Mounted Cartridge}

A cartridge 7 sometimes fails to be properly mounted into the apparatus main assembly. That is, a cartridge 7 sometimes fails to be fully inserted due to an error; a cartridge 7 is sometimes left between the cartridge insertion opening 91 and image formation position. Next, what occurs as the front door 26 is closed when a cartridge 7 is between the cartridge insertion opening 91 and image formation position will be described.

Figure 13:
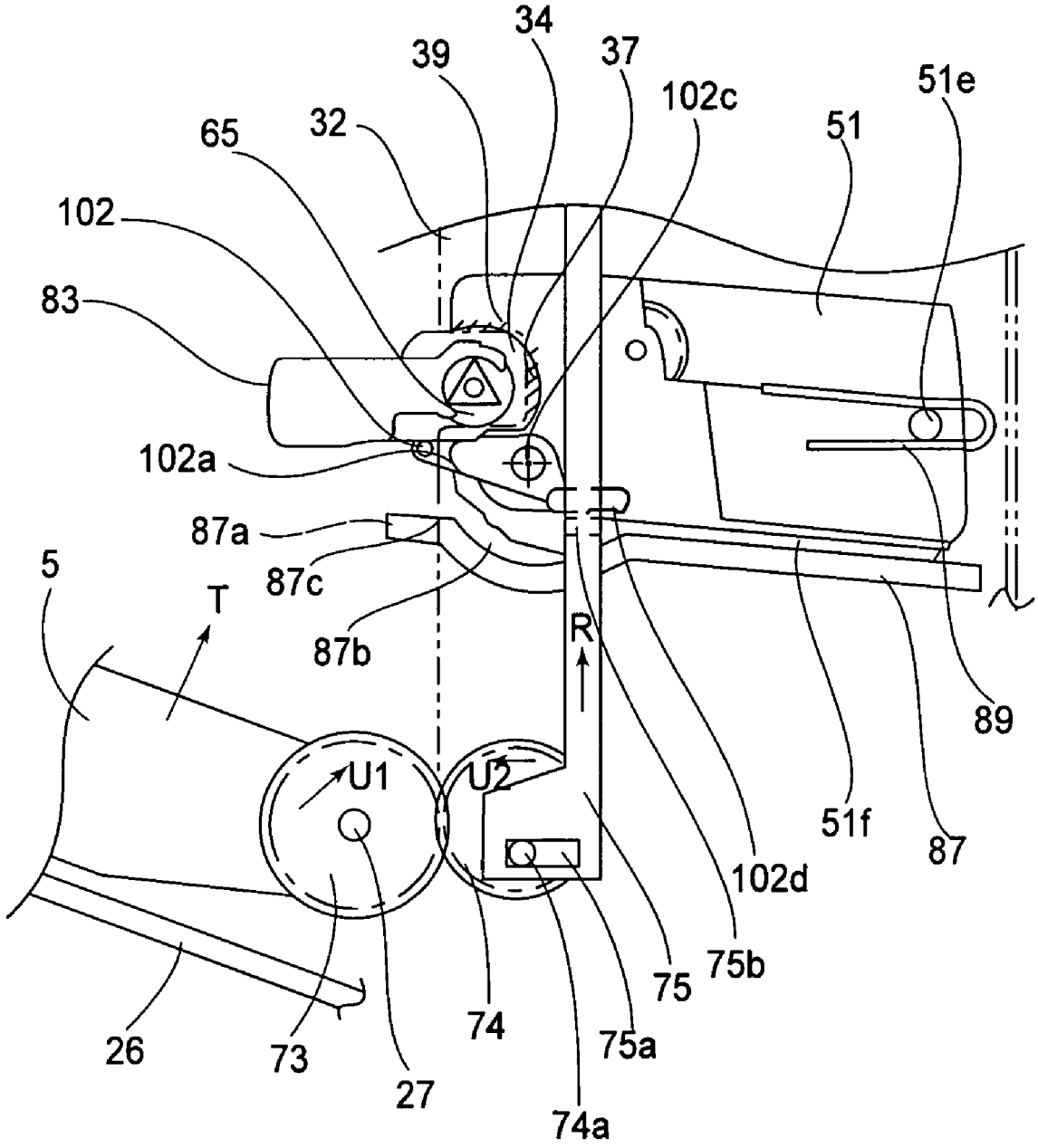
FIG. 13 is a schematic side view of the mechanism, in the first preferred embodiment of the present invention, depicting the operation for opening the shutter of the cartridge in the image forming apparatus main assembly, when the cartridge has not been inserted all the way into the apparatus main assembly.

It is assumed that the cartridge 7 is inserted into the apparatus main assembly 100 in the same manner as that described above. Referring to FIG. 13, the cartridge 7 has been inserted far enough into the apparatus main assembly 100 for the bearing 65 (64), as one of the cartridge supporting portions, to fit into the guiding groove 34 of the right lateral plate 32, but, not far enough to come into contact with the force bearing surface 37 located further downstream in terms of the cartridge mounting direction. Even when the cartridge 7 is in this state, the front door 26 can be closed, and as the front door 26 is closed, the electrostatic transferring means 5 is fully shut against the apparatus main assembly 100 by the closing movement of the front door 26.

Figure 14:
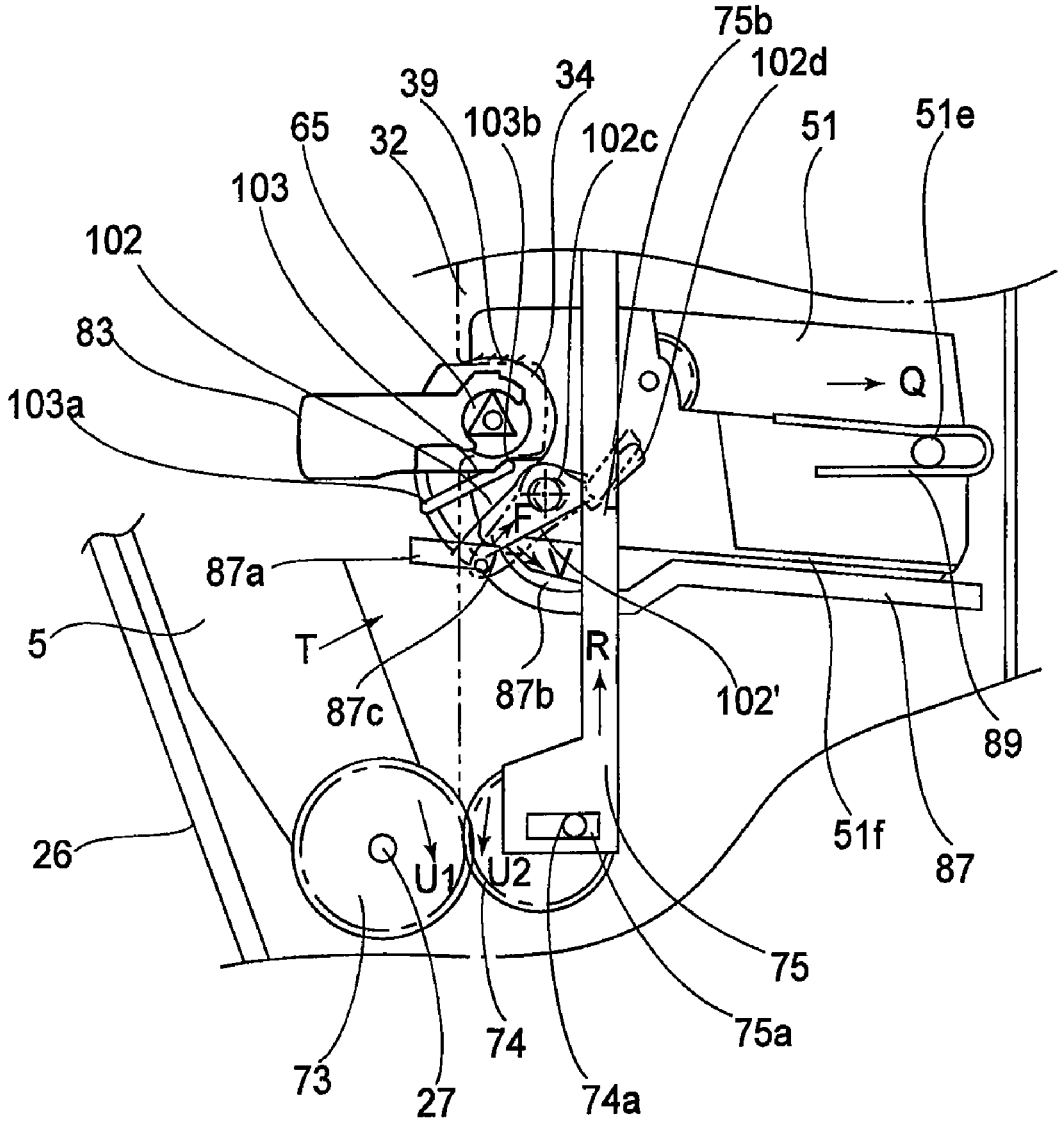
FIG. 14 is a schematic side view of the mechanism, in the first embodiment of the present invention, depicting the operation for opening the shutter of the cartridge in the image forming apparatus main assembly, when the cartridge has not been inserted all the way into the apparatus main assembly.
Figure 15:
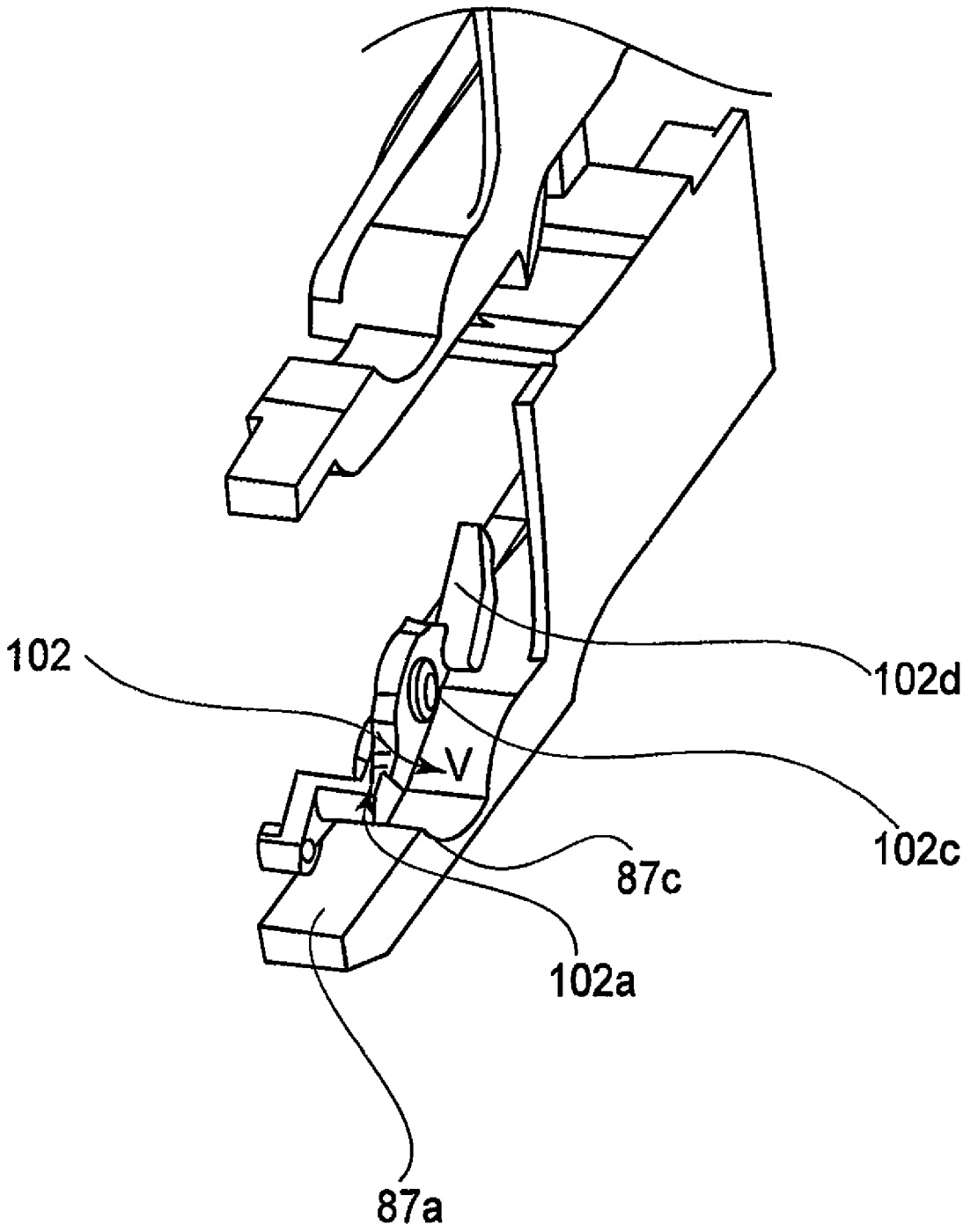
FIG. 15 is a schematic perspective view of the mechanism, in the first embodiment of the present invention, depicting the operation for opening the shutter of the cartridge in the image forming apparatus main assembly, when the cartridge has not been inserted all the way into the apparatus main assembly.

Referring to FIGS. 14 and 15, as the main assembly door 26 is closed, the door 26 and electrostatic transferring means 5 are rotated in the direction indicated by the arrow T about the hinge shaft 27 located at the bottom end of the electrostatic transferring means 5. This movement of the main assembly door 26 causes the hinge gear 73 attached to the hinge shaft 27, to rotate in the direction indicated by the arrow U1. As a result, the gear 74 meshed with the hinge gear 73 is rotated in the direction indicated by the arrow U2.

As described above, the boss 74*a* with which the gear 74 is provided is in the hole 75*a* with which the member 75 for moving the shutter supporting member 102 is provided. Therefore, the movement of the gear 74, which is caused by the closing movement of the main assembly door 26, causes the member 75 to move upward (indicated by arrow R). The member 75 is provided with the portions 75*b*, each of which comes into contact with the arm portion 102*d* of the corresponding shutter supporting member 102 for opening or closing the shutter 101. Thus, as the member 75 is moved upward, each of the portions 75*b* comes into contact with the arm portion 102*d* of the shutter supporting member 102 as a shutter displacing member, and moves (displaces) the shutter supporting member 102. In other words, the shutter supporting member 102 is rotated by the contact between the shutter supporting member 102 and member 75.

Here, in terms of the cartridge mounting direction, each cartridge 7 is on the upstream side of the image formation position in the apparatus main assembly 100. The recess portion 87*b* of the guiding member 87 is provided with a contact area 87*c*, which comes into contact with the contact area 102*a* of the shutter supporting member 102 as the shutter supporting member 102 is rotated about the axial line of the hole 102*c* of the shutter supporting member 102 when the cartridge 7 is in the above described position. As seen from the direction parallel to the lengthwise direction of the cartridge 7, the contact areas 102*a* and 87*c* are arcuate.

Thus, as the contact area 87*c* comes into contact with the contact area 102*a* of the shutter supporting member 102, the contact area 102*a* is subjected to a force F which acts in the direction indicated by an arrow. If the shutter supporting member 102 is further rotated, in this state, in the direction indicated by the arrow V, the contact area 102*a* follows the contact area 87*c* of the guiding member 87. Since the contact area 87*c* is a part of the guiding member 87, and the guiding member 87 is fixed to the lateral plate 32, the contact area 102*a* of the shutter supporting member 102 moves in the direction of the force F, following the contact area 87*c*, while the contact area 87*c* remains stationary. Thus, the holding member 30 presses the bearing 65 (64) upon the force bearing surfaces of the guiding groove 34 after the cartridge 7 which has been moved by the shutter supporting member 102, is moved further downstream in terms of the cartridge mounting direction.

In other words, the shutter supporting member 102 moves into a position 102' outlined by a double-dot chain line in FIG. 14. Therefore, the cartridge 7 is moved downstream (direction indicated by arrow Q), in terms of the cartridge mounting direction, that is, toward the image formation position, by the force F generated by the contact between the contact area 102*a* of the shutter supporting member 102*a* and the contact area 87*c* of the guiding member 87 of the main assembly. Then, as the cartridge 7 is moved toward the image formation position, the bearing 65 (64) of the cartridge 7 is pressed upon the force bearing surface 37 of the lateral plate 32 (31), by the bearing pressing member 30 (FIG. 9) of the apparatus main assembly 100.

Since the contact area 102*a* of the shutter supporting member 102 and the contact area 87*c* of the guiding member 87 are both arcuate, the two are not likely to hook each other when they come into contact with each other. Therefore, the cartridge supporting member 102 is allowed to smoothly rotate.

Therefore, before the door 26 is completely closed against the apparatus main assembly 100, the member 75 for moving the shutter supporting member 102 is moved to cause the shutter 101 to complete its opening movement. Therefore, it does not occur that the shutter 101 comes into contact with the transfer belt 11 while it is opened. Further, the bearing 65 (64) of the cartridge 7 is pressed upon, and held to, the force bearing surface 37 of the guiding groove 34, before the electrostatic transferring means 5 is completely shut against the apparatus main assembly 100. Thus, by the time the door 26 and electrostatic transferring means 5 are completely closed against the apparatus main assembly 100, the transfer belt 11 is placed in contact with the exposed area of the peripheral surface of the photosensitive drum 1 in each cartridge 7 (FIG. 1).

In this embodiment, even if an error causes the cartridge 7 to fail to be inserted all the way into the image formation position when it is mounted into the apparatus main assembly 100, the cartridge 7 is guided into the image formation position by the closing movement of the main assembly door 26 as the main assembly door 26 is closed. Therefore, it does not occur that the transfer belt 11 comes into contact with the shutter which is being opened, nor that the cartridge 7 is pushed further into the apparatus main assembly 100 when the transfer belt 11 is in contact with the photosensitive drum 1.

Therefore, it is assured that even if a user happens to fail to fully insert the cartridge 7 into the apparatus main assembly of an image forming apparatus, the process cartridge is moved toward the image formation position by the movement of the main assembly door. Therefore, it is assured that the image forming apparatus satisfactorily performs an image forming operation.

Miscellaneous Embodiments

In the preceding embodiment, the image forming apparatus was structured so that the shutter 101 is opened or closed by the member 75 for moving the shutter supporting member 101, and also, so that if the cartridge 7 happens to be on the upstream side of the image formation position in terms of the cartridge mounting direction, the cartridge 7 is moved toward the image formation position by the rotation (displacement) of the shutter supporting member as the shutter moving (displacing) member, the movement of which is mechanically linked to the movement of the main assembly door.

However, the abovementioned cartridge moving (displacing) member does not need to be the member for opening or closing the shutter 101. For example, the apparatus main assembly may be provided with a member which is movable by the shutter supporting member moving member 75 of the apparatus main assembly, so that when the cartridge 7 is on the upstream side of the image formation position, in terms of the cartridge mounting direction, it is moved in the cartridge mounting direction by the displacement of the member movable by the member 75. In other words, the cartridge moving member does not need to be such a member as the shutter supporting member 102 in this embodiment that is rotated by the member 75; it may be a member which is slidable by the member 75.

According to the present invention, if a process cartridge happens to fail to be inserted all the way into the image formation position, the cartridge moving member is moved to come into contact with the guiding member so that the process cartridge is moved into the image formation position by the guiding member. Therefore, it is assured that when a user mounts a process cartridge into the main assembly of an electrophotographic image forming apparatus, the process cartridge is placed in the image formation position.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 114237/2005 filed Apr. 12, 2005 which is hereby incorporated by reference.

What is claimed is:

1. A process cartridge detachably mountable to a main assembly of an electrophotographic image forming apparatus including an openable member movable between a closing position for closing an opening in the apparatus and an open position for opening the opening, a guiding member, a main assembly positioning portion, and a main assembly movable member movable in interrelation with movement of the openable member, said process cartridge comprising:

an electrophotographic photosensitive member;

process means actable on said electrophotographic photosensitive member;

a cartridge positioning portion, engageable with the main assembly positioning portion that positions said process cartridge relative to the main assembly;

a cartridge movable member movable by movement of the main assembly movable member, wherein when said process cartridge, upon mounting of said process cartridge to the main assembly of the apparatus through the opening while being guided by the guiding member, stops at a position upstream, with respect to a process cartridge mounting direction, of an image formation position where said cartridge positioning portion is engaged with the main assembly positioning portion, said cartridge movable member is moved by movement of the main assembly movable member to contact said guiding member, by which said cartridge movable member receives, from the guiding member, a force for moving said process cartridge downstream with respect to the mounting direction.

2. A process cartridge according to claim 1, wherein said cartridge movable member functions also as a supporting member that movably supports a shutter that protects said electrophotographic photosensitive member.

3. A process cartridge according to claim 2, wherein said supporting member includes a contact portion which is contactable to the guiding member by the movement of said cartridge movable member caused by the movement of the main assembly movable member, when said process cartridge is being mounted to the main assembly of the apparatus while being guided by the guiding member.

4. An electrophotographic image forming apparatus for forming an image on a recording material, to which a process cartridge is detachably mountable, said apparatus comprising:

(i) an openable member movable between a closing position for closing an opening in said apparatus and an open position for opening the opening;

(ii) a main assembly positioning portion;

(iii) a main assembly movable member movable in interrelation with movement of the openable member; and (iv) a guiding member that guides the process cartridge, the process cartridge including an electrophotographic photosensitive member, process means actable on the electrophotographic photosensitive member, a cartridge positioning portion, engageable with said main assembly positioning portion, that positions the process cartridge relative to said main assembly of said electrophotographic image forming apparatus, and a cartridge movable member movable by movement of said main assembly movable member;

wherein, when the process cartridge, upon mounting of the process cartridge to said main assembly of said apparatus through the opening while being guided by said guiding member, stops at a position upstream, with respect to a process cartridge mounting direction, of an image formation position where the cartridge positioning portion is engaged with said main assembly positioning portion, and the cartridge movable member is moved by movement of said main assembly movable member to contact said guiding member, by which said guiding member applies, to the cartridge movable member, a force for moving the process cartridge downstream with respect to the mounting direction.

5. An apparatus according to claim 4, wherein the cartridge movable member functions also as a supporting member that movably supports a shutter that protects the electrophotographic photosensitive member, and wherein said main assembly movable member moves the shutter in interrelation with the movement of said openable member.

6. An apparatus according to claim 4, wherein said guiding member includes a groove portion to which the cartridge movable member is contactable by movement of said main assembly movable member, when the process cartridge stops at a position upstream, with respect to the process cartridge mounting direction, of a mount position where the cartridge positioning portion is engaged with said main assembly positioning portion, and the cartridge movable member is moved by movement of said main assembly movable member to contact to said guiding member.

7. An apparatus according to claim 6, wherein when the process cartridge is positioned at the mount position, the cartridge movable member is spaced from said guiding member.

8. An apparatus according to claim 4, further comprising a pushing member movable in interrelation with movement of said openable member to urge the cartridge positioning portion to said main assembly positioning portion.

9. An apparatus according to claim 8, wherein said pushing member urges the cartridge positioning portion to said main assembly positioning portion after the process cartridge is moved downstream with respect to the mounting direction.

* * * * *